US009261847B2

(12) United States Patent
Murauchi et al.

(10) Patent No.: US 9,261,847 B2
(45) Date of Patent: Feb. 16, 2016

(54) IMAGE FORMING APPARATUS FOR SETTING AN ELECTRIFICATION VOLTAGE

(71) Applicant: Konica Minolta, Inc., Chiyoda-ku (JP)

(72) Inventors: Junji Murauchi, Toyokawa (JP); Morio Osada, Toyokawa (JP); Kazuki Kobori, Toyokawa (JP); Tomo Kitada, Yokohama (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/619,386

(22) Filed: Feb. 11, 2015

(65) Prior Publication Data

US 2015/0234338 A1 Aug. 20, 2015

(30) Foreign Application Priority Data

Feb. 18, 2014 (JP) ..... 2014-28558

(51) Int. Cl.
*G03G 15/02* (2006.01)
*G03G 15/00* (2006.01)
*G03G 21/20* (2006.01)

(52) U.S. Cl.
CPC ..... *G03G 15/80* (2013.01); *G03G 15/0266* (2013.01); *G03G 21/20* (2013.01); *G03G 15/0283* (2013.01)

(58) Field of Classification Search
CPC ..... G03G 15/0266; G03G 15/0283; G03G 15/80; G03G 21/20
USPC ..... 399/50, 44, 89
See application file for complete search history.

(56) References Cited

U.S. PATENT DOCUMENTS

| | | | | |
|---|---|---|---|---|
| 6,489,069 | B1 | 12/2002 | Itami et al. | |
| 2001/0019669 | A1 | 9/2001 | Watanabe et al. | |
| 2006/0251438 | A1 | 11/2006 | Uchitani et al. | |
| 2012/0230710 | A1 * | 9/2012 | Gomi | 399/44 |
| 2013/0177328 | A1 * | 7/2013 | Fukuda et al. | 399/44 X |

FOREIGN PATENT DOCUMENTS

| | | | |
|---|---|---|---|
| JP | 2000-305291 | A | 11/2000 |
| JP | 2001-201920 | A | 7/2001 |

(Continued)

*Primary Examiner* — Sophia S Chen
(74) *Attorney, Agent, or Firm* — Buchanan Ingersoll & Rooney PC

(57) ABSTRACT

An image forming apparatus includes photoconductors. Electrifiers uniformly electrify surfaces of the photoconductors. A power source applies an electrifying voltage to the electrifiers. A current measurer measures alternating current caused to flow by application of AC voltage by the power source. A controller calculates discharge starting voltage. Environment detectors detect an environment inside of the apparatus. The controller operates the current measurer at each predetermined timing to acquire the discharge starting voltage. When acquiring the discharge starting voltage, the controller changes peak-to-peak voltage at pre-discharge voltage and at post-discharge voltage. The current measurer measures alternating current at measurement points of each of the pre-discharge and post-discharge voltages. The controller calculates a voltage value at an intersection of a first line and a second line. After acquiring the discharge starting voltage, the controller calculates environment-correction discharge starting voltage, and sets electrification voltage based on the calculated voltage.

20 Claims, 17 Drawing Sheets

(56) References Cited

FOREIGN PATENT DOCUMENTS

| | | | |
|---|---|---|---|
| JP | 2001-201921 | A | 7/2001 |
| JP | 2006-343710 | A | 12/2006 |
| JP | 2007-199094 | A | 8/2007 |
| JP | 2010-286613 | A | 12/2010 |

* cited by examiner

FIG. 6

111

DT1

| Measurement voltage | Environment value | | | |
|---|---|---|---|---|
| | S1 | S2 | S3 | S4 |
| VPP 1 | 1300 | 1200 | 1100 | 1000 |
| VPP 2 | 1400 | 1300 | 1200 | 1100 |
| VPP 3 | 1500 | 1400 | 1300 | 1200 |
| VPP 4 | 1600 | 1500 | 1400 | 1300 |
| VPP 5 | 1900 | 1800 | 1700 | 1600 |
| VPP 6 | 2000 | 1900 | 1800 | 1700 |
| VPP 7 | 2100 | 2000 | 1900 | 1800 |
| VPP 8 | 2200 | 2100 | 2000 | 1900 |

DT2

| EV* | S1 | S2 | S3 | S4 |
|---|---|---|---|---|
| CV**VX | −200 | −100 | 0 | 0 |

*Environment value **Correction value

DT3

| EV* | S1 | S2 | S3 | S4 |
|---|---|---|---|---|
| CV** VY | +200 | +100 | 0 | 0 |

*Environment value **Correction value

DT4

| Measurement voltage | | | | |
|---|---|---|---|---|
| VPP 1A | VPP 2A | VPP RV* | VPP 3A | VPP 4A |
| VPP−200 | VPP−100 | VPP 0 | VPP+100 | VPP+200 |

*Reference value

| Number of photoconductor rotations [KROT] | Correction value $v_z$ |
|---|---|
| 100 | 0 |
| 200 | 0 |
| 300 | 0 |
| 400 | 15 |
| 500 | 20 |
| 600 | 25 |
| 700 | 30 |
| 800 | 35 |

| Discharge starting voltage VTH | Correction value Vz |
|---|---|
| VTH0 | 0 |
| VTH0−50 | 0 |
| VTH0−100 | 0 |
| VTH0−150 | 10 |
| VTH0−200 | 15 |
| VTH0−250 | 20 |
| VTH0−300 | 25 |
| VTH0−350 | 30 |
| VTH0−400 | 35 |

| Discharge starting voltage VTH | Correction value Vz |
|---|---|
| 1800 | 0 |
| 1750 | 0 |
| 1700 | 0 |
| 1650 | 10 |
| 1600 | 15 |
| 1550 | 20 |
| 1500 | 25 |
| 1450 | 30 |
| 1400 | 35 |

| Number of photoconductor rotations [KROT] | Measurement DC voltage VG1 |
|---|---|
| 100 | VG |
| 200 | VG |
| 300 | VG |
| 400 | VG−50 |
| 500 | VG−100 |
| 600 | VG−150 |
| 700 | VG−200 |
| 800 | VG−250 |

| Discharge starting voltage VTH | Measurement DC voltage VG1 |
|---|---|
| VTH0 | −500 |
| VTH0−50 | −500 |
| VTH0−150 | −500 |
| VTH0−250 | −500 |
| VTH0−350 | −450 |
| VTH0−450 | −400 |
| VTH0−550 | −350 |
| VTH0−650 | −300 |
| VTH0−750 | −250 |

IMAGE FORMING APPARATUS FOR SETTING AN ELECTRIFICATION VOLTAGE

CROSS-REFERENCE TO RELATED APPLICATIONS

The present application claims priority under 35 U.S.C. §119 to Japanese Patent Application No. 2014-028558, filed Feb. 18, 2014. The contents of this application are incorporated herein by reference in their entirety.

BACKGROUND OF THE INVENTION

1. Field of the Invention

The present invention relates to an image forming apparatus.

2. Discussion of the Background

Conventionally, an image forming apparatus of electrophotography has included an electrifier to electrify the surface of each photoconductor. As this electrifier, there have been known contact electrifiers of, for example, a roller type and a blade type. Moreover, among such contact electrifiers, there have been known electrifiers to which an electrifying voltage having an alternating-current (AC) voltage superposed on a direct-current (DC) voltage is applied. It should be noted that in the following description, not only an electrifier in direct contact with a photoconductor but also an electrifier not in contact but closely adjacent will be referred to as a contact electrifier.

When the AC voltage is applied, a contact electrifier causes discharge between the electrifier and a photoconductor to appropriately electrify the surface of the photoconductor. Excessive discharge caused by the electrifier may damage the photoconductor. In view of this, the magnitude of AC component of the electrifying voltage applied to the electrifier is controlled to maintain an amount of discharge within a suitable range (see Japanese Unexamined Patent Application Publication No. 2001-201920 and Japanese Unexamined Patent Application Publication No. 2007-199094). Furthermore, image forming apparatuses recited in Japanese Unexamined Patent Application Publication No. 2001-201920 and Japanese Unexamined Patent Application Publication No. 2007-199094 include environment sensors to detect environmental changes inside of the apparatuses such as temperature and humidity. In accordance with the environmental changes inside of the apparatuses detected by such environment sensors, AC component of the electrifying voltage applied to the electrifier is controlled.

The contents of Japanese Unexamined Patent Application Publication No. 2001-201920 and Japanese Unexamined Patent Application Publication No. 2007-199094 are incorporated herein by reference in their entirety.

Recently, there has been a demand for increasing the thickness of a photosensitive layer to prolong the service life of a photoconductor. Therefore, as the frequency of use of the photoconductor increases, the photosensitive layer becomes thinner than an initial state. Consequently, application of the electrifying voltage having AC component set in the initial state may unfortunately cause excessive discharge with respect to the photoconductor.

In this respect, in the image forming apparatus disclosed in Japanese Unexamined Patent Application Publication No. 2001-201920, the AC component of the electrifying voltage is set based on a plurality of measurement points in the initial stage. However, the AC component of the electrifying voltage is then set based on a value measured in the printing step and a setting log. This decreases setting accuracy. Also, in the image forming apparatus disclosed in Japanese Unexamined Patent Application Publication No. 2007-199094, there is only one measurement point to cause discharge with respect to the photoconductor. Similarly to the image forming apparatus disclosed in Japanese Unexamined Patent Application Publication No. 2001-201920, setting accuracy of the AC component of the electrifying voltage is not high. Therefore, when the image forming apparatuses disclosed in Japanese Unexamined Patent Application Publication No. 2001-201920 and Japanese Unexamined Patent Application Publication No. 2007-199094 include the photoconductor having a thick photosensitive layer in the initial state, it is difficult to set the optimum electrifying voltage depending on states of use.

In view of the above-described problems, it is an object of the present invention to provide an image forming apparatus to set the optimum electrifying voltage even though a photoconductor having a thick photosensitive layer is used.

SUMMARY OF THE INVENTION

According to one aspect of the present invention, an image forming apparatus includes photoconductors, electrifiers, a power source, a current measurer, a controller, and environment detectors. The photoconductors are configured to carry electrostatic latent images. The electrifiers are disposed in contact with or adjacent to the respective photoconductors and configured to uniformly electrify surfaces of the photoconductors. The power source is configured to apply an electrifying voltage to the electrifiers. The electrifying voltage has an AC voltage superposed on a DC voltage. The current measurer is configured to measure an alternating current caused to flow by application of an AC voltage by the power source. The controller is configured to calculate a discharge starting voltage, which is a peak-to-peak voltage of the AC voltage at which discharge between the photoconductor and the electrifier is started. The environment detectors are configured to detect an environment inside of the apparatus. The controller is configured to operate the current measurer at each predetermined timing to acquire the discharge starting voltage. The controller is configured to, when acquiring the discharge starting voltage, change the peak-to-peak voltage of the AC voltage applied by the power source in at least two stages at pre-discharge voltage lower than the discharge starting voltage and at post-discharge voltage higher than the discharge starting voltage. The current measurer is configured to measure alternating current at two or more measurement points of each of the pre-discharge voltage and the post-discharge voltage. The controller is configured to calculate a voltage value at an intersection of a first line and a second line. The first line is acquired from a relationship between a peak-to-peak voltage of an AC voltage and an alternating current at two or more measurement points of the pre-discharge voltage. The second line is acquired from a relationship between a peak-to-peak voltage of an AC voltage and an alternating current at two or more measurement points of the post-discharge voltage. The controller is configured to, after acquiring the discharge starting voltage, calculate an environment-correction discharge starting voltage by correcting the discharge starting voltage based on the environment inside of the apparatus detected by the environment detectors. The controller is configured to set an electrification voltage based on the environment-correction discharge starting voltage. The electrification voltage is a peak-to-peak voltage of the AC voltage applied by the power source in image formation.

According to the embodiment of the present invention, alternating current is measured at two or more measurement points of each of the pre-discharge voltage and the post-discharge voltage. Based on a measurement result, the electrification voltage (AC component of the electrifying voltage) is set. Consequently, in accordance with an amount of change in the thickness of the photosensitive layer depending on the frequency of use of the photoconductor, the optimum electrification voltage is set. In order to prolong the service life of the photoconductor, the thickness of the photosensitive layer is increased. Even in the case of the photoconductor having such a thick photosensitive layer, an electrification state is constantly maintained appropriately. At the same time, excessive discharge is suppressed to prevent damage to the photoconductor.

According to the embodiment of the present invention, in the second and subsequent measurement, the number of measurement points is smaller than the number of measurement points in the first measurement. This shortens the time for the second and subsequent measurement and reduces the power consumption required for the measurement. Moreover, according to the embodiment of the present invention, the thickness deviation of the photosensitive layer is predicted to correct the electrification voltage based on the thickness deviation. This suppresses random variation in electrification states due to the thickness deviation, and enables image formation of high definition with less image irregularity. Furthermore, according to the embodiment of the present invention, the DC voltage applied for the measurement is set to be smaller than the absolute value of the DC voltage applied for image formation. Therefore, in the measurement at the post-discharge voltage, leak current is prevented from flowing to the photoconductor owing to excessive discharge. This suppresses damage to the photoconductor.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6 is a schematic diagram illustrating a configuration of a memory in an image forming apparatus according to a first embodiment;

DESCRIPTION OF THE EMBODIMENTS

Figure 2:
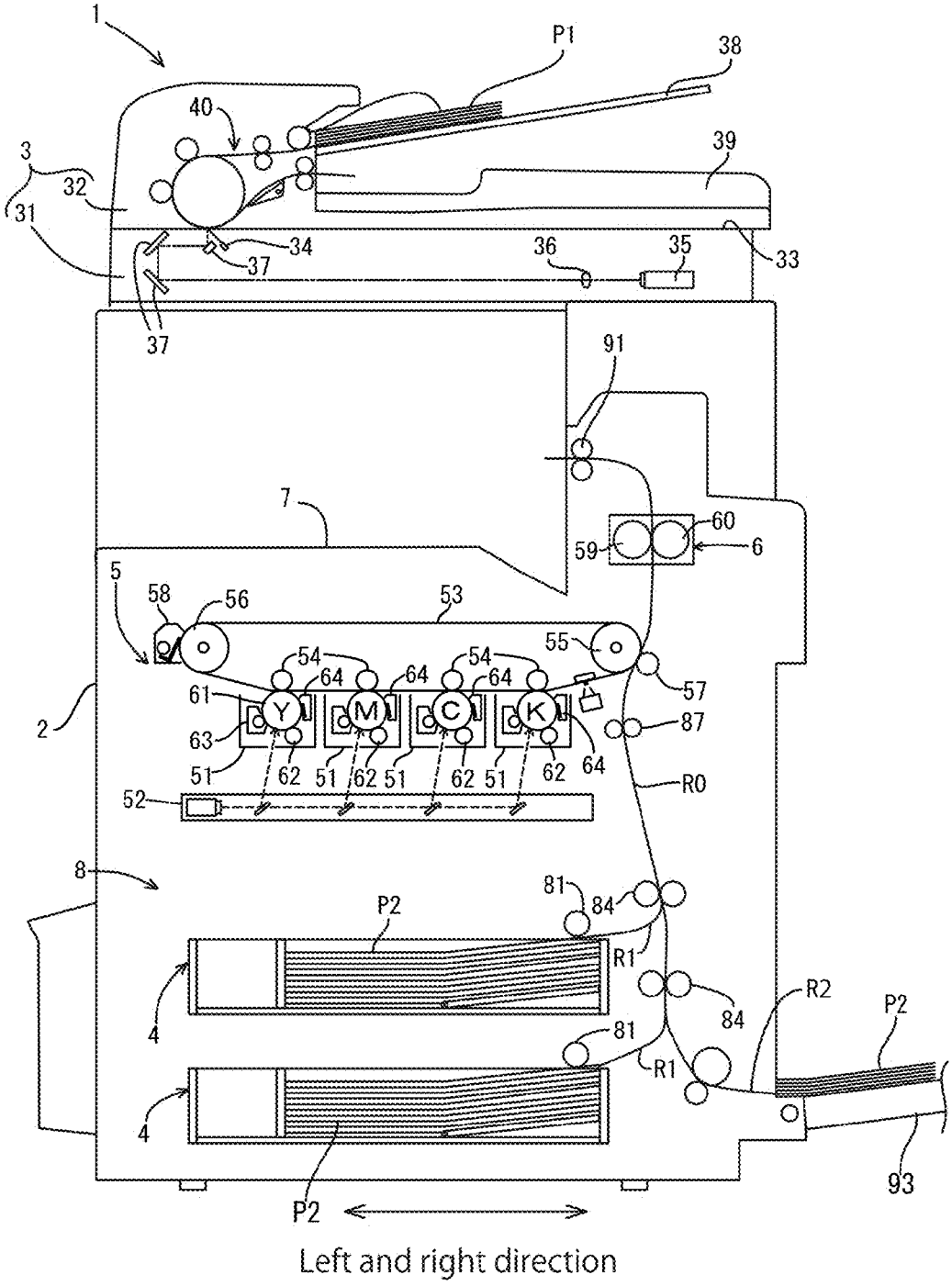
FIG. 2 is a schematic diagram illustrating an internal configuration of the image forming apparatus shown in FIG. 1.

Embodiments of the present invention will be described below with reference to the accompanying drawings. In the following description, terms to represent specific directions and positions (such as "left and right" and "above and below") are used as necessary. In such an occasion, a view as seen in a direction perpendicular to the surface of the sheet of FIG. 2 is a front view. This direction is regarded as a reference. Such terms are intended only for convenience's sake of description, and will not limit the technical scope of the present invention.

<Configuration of Image Forming Apparatus>

Figure 1:
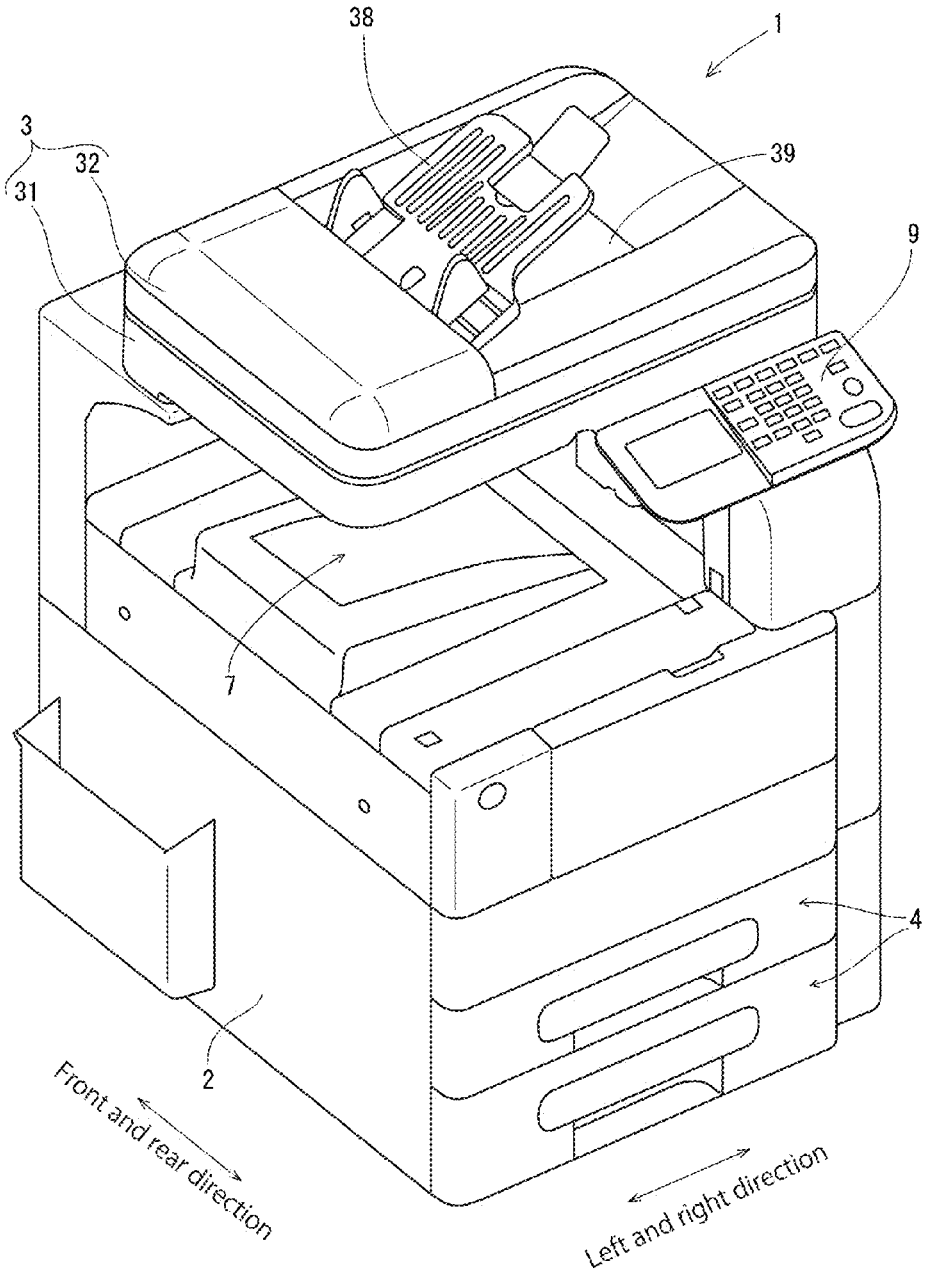
FIG. 1 is an external perspective view of an image forming apparatus according to the embodiment of the present invention.

First, the general arrangement of an image forming apparatus according to an embodiment of the present invention will be described below with reference to the drawings. FIG. 1 is an external perspective view of the image forming apparatus according to the embodiment. FIG. 2 is a schematic diagram illustrating an internal configuration of the image forming apparatus.

As shown in FIGS. 1 and 2, the image forming apparatus 1 includes an image reader 3, sheet feed trays 4, a transfer unit 5, a fixing unit 6, a sheet discharge tray 7, and an operation panel 9. The image reader 3 reads an image from a document P1. The sheet feed trays 4 contain recording sheets P2 on which images are to be formed. The transfer unit 5 transfers a toner image to each recording sheet P2 fed from the sheet feed tray 4. The fixing unit 6 fixes the toner image, which has been transferred by the transfer unit 5, onto the recording sheet P2. The recording sheet P2 on which the image is fixed and formed at the fixing unit 6 is discharged to the sheet discharge tray 7. The operation panel 9 receives operation commands to the image forming apparatus 1. In the image forming apparatus 1, the image reader 3 is disposed on an upper portion of an apparatus main body 2. The transfer unit 5 is disposed below the image reader 3.

The sheet discharge tray 7 is disposed above the transfer unit 5 in the apparatus main body 2 so as to receive the recording sheet P2 discharged after the image is recorded at the transfer unit 5 and the fixing unit 6. The sheet feed trays 4 are detachably inserted below the transfer unit 5 in the apparatus main body 2. With this configuration, as will be described later, a recording sheet P2 contained in the sheet feed tray 4 is fed into the apparatus main body 2 and conveyed upwardly. An image is transferred onto the recording sheet P2 in the transfer unit 5 above the sheet feed tray 4 and fixed in the fixing unit 6. Then, the recording sheet P2 is discharged to the sheet discharge tray 7 disposed in a space (recessed space) between the image reader 3 and the transfer unit 5.

The image reader 3 on the upper portion of the apparatus main body 2 includes a scanner 31 and an automatic document feeder (ADF) 32. The scanner 31 reads an image from a document P1. The ADF 32 is disposed on an upper portion of the scanner 31 and feeds documents P1 to the scanner 31 one by one. The operation panel 9 is disposed on the front side of the apparatus main body 2. The user operates the keys while checking, for example, a monitor of the operation panel 9. Thus, the user performs setting of a function selected from various kinds of functions of the image forming apparatus 1, and instructs the image forming apparatus 1 to execute work.

Next, referring to FIG. 2, the internal configuration of the apparatus main body 2 will be described. The scanner 31 of the image reader 3 on the upper portion of the apparatus main body 2 includes a document table 33, a light source 34, an image sensor 35, an image formation lens 36, and a mirror group 37. The document table 33 includes platen glass (not shown) on an upper surface thereof. The light source 34 irradiates a document P1 with light. The image sensor 35 performs photoelectric conversion of reflected light from the document P1 into image data. The image formation lens 36 forms an image of the reflected light on the image sensor 35. The mirror group 37 reflects the reflected light from the document P1 successively to make the reflected light incident on the image formation lens 36. The light source 34, the image sensor 35, the image formation lens 36, and the mirror group 37 are disposed inside of the document table 33. The light source 34 and the mirror group 37 are arranged to be laterally movable with respect to the document table 33.

On the upper side of the scanner 31, the ADF 32 is disposed to be openable from the document table 33 in a cantilever manner. The ADF 32 extends over the document P1 on the platen glass (not shown) of the document table 33, thus also serving to bring the document P1 in close contact with the platen glass (not shown). The ADF 32 includes a document mounting tray 38 and a document discharge tray 39.

When the image reader 3 of the above-described configuration reads a document P1 on the platen glass (not shown) of the document table 33, the light source 34 moving in the right direction (subscanning direction) irradiates the document P1 with light. The light reflected from the document P1 is successively reflected by the mirror group 37 moving in the right direction similarly to the light source 34. The reflected light is made incident on the image formation lens 36, and an image of the reflected light is formed on the image sensor 35. In accordance with the intensity of the incident light, the image sensor 35 executes photoelectric conversion of each picture element and generates image signals (RGB signals) corresponding to the image of the document P1.

In reading a document P1 on the document mounting tray 38, the document P1 is conveyed to a reading position by a document conveyance mechanism 40 including components such as a plurality of rollers. At this time, the light source 34 and the mirror group 37 of the scanner 31 are fixed at predetermined positions inside of the document table 33. Therefore, a portion of the document P1 at the reading position is irradiated with the light from the light source 34. Through the mirror group 37 and the image formation lens 36 of the scanner 31, an image of the reflected light is formed on the image sensor 35. Then, the image sensor 35 converts the formed image into image signals (RGB signals) corresponding to the image of the document P1, and the document P1 is discharged to a document discharge tray 39.

The transfer unit 5 to transfer a toner image to a recording sheet P2 includes image formation portions 51, an exposure portion 52, an intermediate transfer belt 53, primary transfer rollers 54, a drive roller 55, a driven roller 56, a secondary transfer roller 57, and a cleaner 58. The image formation portions 51 respectively generate toner images of colors yellow (Y), magenta (M), cyan (C), and black (K). The exposure portion 52 is disposed below the image formation portions 51. The intermediate transfer belt 53 is in contact with the image formation portions 51 of the colors disposed horizontally. The toner images of the colors are transferred from the image formation portions 51 to the intermediate transfer belt 53. The primary transfer rollers 54 are respectively disposed above and opposite to the image formation portions 51 of the colors in such a manner that the primary transfer rollers 54 and the image formation portions 51 clamp the intermediate transfer belt 53. The drive roller 55 rotates the intermediate transfer belt 53. Rotation of the drive roller 55 is transmitted to the driven roller 56 through the intermediate transfer belt 53 to rotate the driven roller 56. The secondary transfer roller 57 is disposed opposite to the drive roller 55 with the intermediate transfer belt 53 interposed therebetween. The cleaner 58 is disposed opposite to the driven roller 56 with the intermediate transfer belt 53 interposed therebetween.

Each of the image formation portions 51 includes a photoconductive drum 61, an electrifier 62, a developer 63, and a cleaner 64. The photoconductive drum 61 is in contact with an outer peripheral surface of the intermediate transfer belt 53. The electrifier 62 electrifies an outer peripheral surface of the photoconductive drum 61. After stirring and electrifying toner, the developer 63 applies the toner to the outer peripheral surface of the photoconductive drum 61. After the toner image is transferred to the intermediate transfer belt 53, the cleaner 64 removes residual toner on the outer peripheral surface of the photoconductive drum 61. At this time, the photoconductive drum 61 is disposed opposite to the primary transfer roller 54 with the intermediate transfer belt 63 interposed therebetween. Also, the photoconductive drum 61 rotates clockwise, as seen in FIG. 2. Around the photoconductive drum 61, the primary transfer roller 54, the cleaner 64, the electrifier 62, and the developer 63 are disposed in sequence in the rotation direction of the photoconductive drum 61.

The intermediate transfer belt 53 is made of, for example, an endless belt member having electric conductivity, and wound around the drive roller 55 and the driven roller 56 without slackness. Thus, in accordance with rotation of the drive roller 55, the intermediate transfer belt 53 rotates counterclockwise, as seen in FIG. 2. Around the intermediate transfer belt 53, the secondary transfer roller 57, the cleaner 58, and the image formation portions 51 of the colors Y, M, C, and K are disposed in sequence in the rotation direction of the intermediate transfer belt 53.

In order to fix the toner image transferred to the recording sheet P2, the fixing unit 6 includes a heating roller 59 and a pressurizing roller 60. The heating roller 59 includes a heat source such as a halogen lamp to heat and fix the toner image on the recording sheet P2. The pressurizing roller 60 clamps the recording sheet P2 with the heating roller 59 and pressurizes the recording sheet P2. It should be noted that the heating roller 59 may produce eddy current on the surface by electromagnetic induction to heat the surface of the heating roller 59.

A sheet feed unit 8 including a plurality of sheet feed trays 4 is provided with draw rollers 81. Each of the draw rollers 81 draws out recording sheets P2 contained in the sheet feed tray 4 from an uppermost sheet to a sheet feed path R1. A main conveyance path R0 is a route in which the recording sheet P2 mainly passes in the steps of image formation (printing). The sheet feed path R1 is provided for each of the sheet feed trays 4 and communicates with the main conveyance path R0. The recording sheets P2 in the sheet feed tray 4 are drawn out one by one from an uppermost sheet to the sheet feed path R1 by rotation of the corresponding draw roller 81. Then, the recording sheet P2 is sent to the main conveyance path R0.

A manual bypass tray 93 is disposed on a lateral side portion (right side portion in this embodiment) of the apparatus main body 2. With the manual bypass tray 93, recording sheets P2 of a predetermined size are fed from the outside. The manual bypass tray 93 is an auxiliary tray in addition to the normal sheet feed trays 4 inside of the apparatus main body 2. The manual bypass tray 93 is attached to the lateral side portion of the apparatus main body 2 rotatably to be open from and closed to the apparatus main body 2. By rotation of a draw roller and such components, the recording sheets P2 on the manual bypass tray 93 are drawn out one by one from an uppermost sheet and sent through a bypass sheet feed path R2 toward the main conveyance path R0. Further, a sheet discharge roller pair 91 to discharge the printed recording sheet P2 are disposed on the most downstream end of the main conveyance path R0. The printed recording sheet P2 is discharged to the sheet discharge tray 7 by rotation of the sheet discharge roller pair 91.

<Printing Operation>

Next, description will be made on printing operation by the image forming apparatus 1. When receiving a command through the operation panel 9 or an external terminal to start the printing operation, the image forming apparatus 1 starts control operation for the printing operation. First, the sheet feed unit 8 drives the draw roller 81 to draw out an uppermost recording sheet P2 from the sheet feed tray 4 and feed the recording sheet P2 to the sheet feed path R1. The recording sheet P2, which has been fed from the sheet feed tray 4 to the sheet feed path R1, is sent from the sheet feed path R1 to the vertical main conveyance path R0 through a vertical conveyance roller pair 84.

Based on image data of the colors Y, M, C, and K, light emitting diodes (not shown) inside of the exposure portion 52 are driven to form electrostatic latent images on the photoconductive drums 61 of the respective colors Y, M, C, and K. Specifically, in each of the image formation portions 51 of the colors Y, M, C, and K, the photoconductive drum 61 is electrified by the electrifier 62, and the surface of the photoconductive drum 61 is irradiated with a laser beam from the exposure portion 52. Thus, an electrostatic latent image corresponding to an image of each of the colors Y, M, C, and K is formed.

Toner electrified by the developer 63 is transferred to the surface of the photoconductive drum 61 on which the electrostatic latent image is formed, and a toner image is formed on the photoconductive drum 61 serving as a first image carrier (development). When the toner image carried on the surface of the photoconductive drum 61 and rendered manifest is brought into contact with the intermediate transfer belt 53, the toner image is transferred to the intermediate transfer belt 53 by transfer current or transfer voltage applied to the primary transfer roller 54. Consequently, the toner images of the colors Y, M, C, and K superposed on each other are formed on the surface of the intermediate transfer belt 53 serving as a second image carrier (primary transfer). After the toner image is transferred to the intermediate transfer belt 53, the toner, which has not been transferred but remained on the photoconductive drum 61, is scraped by the cleaner 64 and removed from the surface of the photoconductive drum 61.

The recording sheet P2 conveyed to the main conveyance path R0 reaches a timing roller pair 87. At the timing when the toner image is transferred to the intermediate transfer belt 53, the timing roller pair 87 are operated to convey the recording sheet P2 to the transfer unit 5. When the intermediate transfer belt 53 is rotated by the drive roller 55 and the driven roller 56, the toner image transferred to the intermediate transfer belt 53 moves to a transfer nip area in contact with the secondary transfer roller 57 and is transferred to the recording sheet P2 conveyed to the transfer nip area on the main conveyance path R0 (secondary transfer). After the toner image is transferred to the recording sheet P2, the toner, which has not been transferred but remained on the intermediate transfer belt 53, is scraped by the cleaner 58 and removed from the surface of the intermediate transfer belt 53.

After the toner image is transferred to the recording sheet P2 at the position in contact with the secondary transfer roller 57, the recording sheet P2 is conveyed to the fixing unit 6 made up of the heating roller 59 and the pressurizing roller 60. When the heating roller 59 and the pressurizing roller 60 are rotated, the heating roller 59 heats the recording sheet P2 at the same time. Thus, the recording sheet P2 on one side of which the unfixed toner image is carried passes a fixing nip portion of the fixing unit 6. Then, the recording sheet P2 is heated and pressurized by the heating roller 59 and the pressurizing roller 60 to fix the unfixed toner image on the recording sheet P2. After the toner image is fixed (after single-side printing), the recording sheet P2 is conveyed to the sheet discharge roller pair 91 and discharged to the sheet discharge tray 7 by the sheet discharge roller pair 91.

<Configuration of Image Formation Portion>

Figure 3:
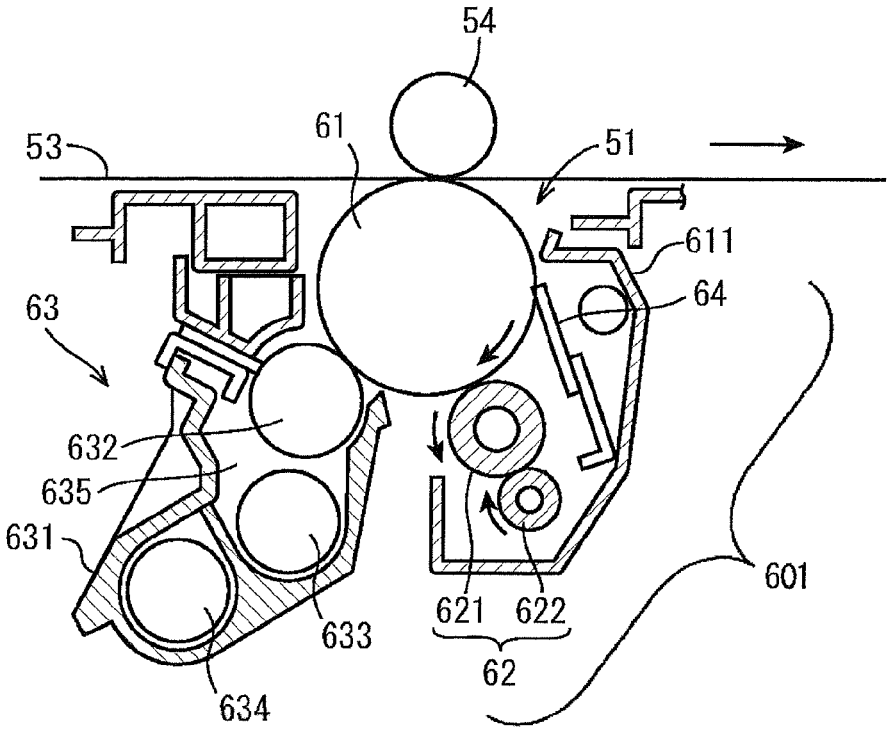
FIG. 3 is a schematic diagram illustrating a configuration of an image formation portion in the image forming apparatus shown in FIG. 1.

Detailed configurations of components of the image formation portion 51 will be described below. As shown in FIG. 3, the electrifier 62 includes an electrification roller 621 and a cleaning roller 622. The cleaning roller 622 is in contact with the electrification roller 621 at a position on a side opposite to the photoconductive drum 61 side. The electrifier 62, the photoconductive drum 61, and the cleaner 64 are housed in a drum housing 611 and constitute a photoconductor unit 601. The photoconductor unit 601 is detachably attached to the apparatus main body 2 (apparatus frame). Needless to say, a specific configuration may be selected as desired. For example, the electrifier 62 and the cleaner 64 may constitute a single detachable unit.

The electrification roller 621 includes a shaft on which a conductive rubber elastic layer is formed. A nip is formed in a portion of the electrification roller 621 that is in contact with the photoconductive drum 61. A rough surface layer is formed on the surface of the conductive rubber elastic layer of the electrification roller 621. The conductive rubber elastic layer of the electrification roller 621 is made of an elastic material, for example, epichlorohydrin rubber (such as ECO and CO), nitrile rubber (NBR), ethylene-propylene-diene rubber (EPDM), silicone rubber, urethane rubber, styrene-butadiene rubber (SBR), isoprene rubber (IR), chloroprene rubber (CR), and natural rubber (NR). In particular, ethylene-propylene-diene rubber (EPDM), epichlorohydrin rubber, and nitrile rubber are preferably adopted.

As a conductive material to be mixed in an elastic material constituting the conductive rubber elastic layer, there are adopted carbon black such as Ketjen black and acetylene black, graphite, metal powder, conductive metallic oxide, various ionic conductive materials such as quaternary ammonium salt such as tetramethylammonium perchlorate, trimethyloctadecylammonium perchlorate, and benzyltrimethylammonium chloride. In order to roughen the surface layer formed on the surface of the conductive rubber elastic layer, the surface of the conductive rubber elastic layer is coated with coating resin to which roughening particles are added. The roughening particles are organic particles or inorganic particles having an average diameter of several μm to several ten μm. The roughness of the surface layer is regulated by changing the size and addition amount of the particles and the coating thickness.

The cleaning roller 622 includes a metal shaft on which a conductive elastic material is wound. The cleaning roller 622 is in contact with the electrification roller 621 under a predetermined pressure. Consequently, the nip is formed in the contact portion of the cleaning roller 622 with the electrification roller 621. The cleaning roller 622 is disposed on the side of the axis of the electrification roller 621 that is opposite to the photoconductive drum 61 side. In other words, the cleaning roller 622 is in contact with the outer peripheral surface of the electrification roller 621 at the farthest portion from the photoconductive drum 61.

The developer 63 includes a developer housing 631, a development roller 632, a supply roller 633, a stirring roller 634, and a development chamber 635. The development chamber 635 contains a carrier and a toner as a developing solution. A development bias having an AC voltage superposed on a DC voltage is applied to the development roller 632. An electrostatic latent image formed on the surface of the photoconductive drum 61 is developed by the toner under the effect of the development bias. Thus, a toner image is formed on the surface of the photoconductive drum 61. It should be noted that the toner includes a coloring agent in a binder resin to which an external additive is added and processed. Desirably, the toner has a particle diameter of 3 to 15 μm although this should not be construed in a limiting sense. As necessary, the binder resin contains a charge control agent and a release agent.

The toner in the developing solution is produced by a conventional method in general use such as pulverization, emulsion polymerization, and suspension polymerization. Examples of the binder resin for the toner include styrene resin (homopolymer or copolymer containing styrene or styrene substitution product), polyester resin, epoxy resin, vinyl chloride resin, phenol resin, polyethylene resin, polypropylene resin, polyurethane resin, and silicone resin. Preferably, the binder resin, which is a simple one of these resins or a complex of these resins, has a softening temperature of 80° C. to 160° C. or a glass transition point of 50° C. to 75° C.

As the coloring agent, conventional coloring agents in general use are adopted. Examples include carbon black, aniline black, active carbon, magnetite, benzine yellow, permanent yellow, naphthol yellow, phthalocyanine blue, fast sky blue, ultramarine blue, rose bengal, and lake red. Preferably, the coloring agent is used to be 2 to 20 weight % with respect to 100 weight % of the above-described binder resin.

As the charge control agent contained in the binder resin, in the case of a positively electrifiable toner, nigrosine dye, quaternary ammonium salt compound, triphenylmethane compound, imidazole compound, and polyamine resin are used. In the case of the charge control agent for a negatively electrifiable toner, azo dye containing metal such as chromium, cobalt, aluminum, and iron, salicylic acid metal compound, alkyl salicylic acid metal compound, and calixarene compound are used. Preferably, the charge control agent is used to be 0.1 to 10 weight % with respect to 100 weight % of the binder resin. As the release agent contained in the binder resin, polyethylene, polypropylene, carnauba wax, and Sasolwax are singly used or a combination of two or more of these release agents is used. Preferably, the release agent is used to be 0.1 to 10 weight % with respect to 100 weight % of the binder resin.

Particles (external additive) are externally added to the toner to improve fluidity. For example, silica, titanium oxide, and aluminum oxide are used. In particular, these particles are preferably made water-repellant by silane coupler, titanium coupler, and silicone oil. Preferably, the fluidizer serving as the external additive is used to be 0.1 to 5 weight % with respect to 100 weight % of the toner. Also, preferably, the external additive has an average primary particle diameter of 10 to 100 nm.

As the carrier, for example, binder carrier and coat carrier are used. Preferably, the carrier has a particle diameter of 15 to 100 μm although this should not be construed in a limiting sense. The toner and the carrier are mixed at a ratio controlled to acquire a predetermined amount of toner electrification. Preferably, the toner ratio to the sum of the toner and the carrier is 3 to 30 weight %. Further preferably, the toner ratio is 4 to 20 weight %.

The binder carrier includes the binder resin in which magnetic particles are dispersed. Also, positively or negatively electrifiable particles are fixed to the surface of the carrier, or a surface coating layer is formed on the surface of the carrier. Electrification properties of the binder carrier is controlled by a material of the binder resin, the electrifiable particles, and a kind of the surface coating layer. As the binder resin, thermoplastic resin such as vinyl resin represented by polystyrene resin, polyester resin, nylon resin, and polyolefin resin, and thermosetting resin such as phenol resin are used.

As the magnetic particles dispersed in the binder carrier, for example, there are used spinel ferrite such as magnetite and γ iron oxide, spinel ferrite containing one or more of metals other than iron (such as manganese, nickel, magnesium, and copper), magnetoplumbite ferrite such as barium ferrite, and particles of iron or alloy covered with iron oxide. When high magnetization is required, iron ferromagnetic particles are preferably used. When chemical stability is considered, ferromagnetic particles of spinel ferrite or magnetoplumbite ferrite are preferably used. A kind and content of the ferromagnetic particles are suitably selected to obtain a carrier having a predetermined magnetization. The magnetic particles may have a particulate or spherical or pin shape. Preferably, 50 to 90 weight % magnetic particles are added to the carrier.

In the case of the binder carrier on which electrifiable or conductive particles are fixed, the particles are uniformly mixed in magnetic resin carrier and attached to the surface of the carrier. Then, exertion of mechanical or thermal impact causes the particles to be hit and fixed into the magnetic resin carrier on the surface of the carrier. At this time, the particles are not completely embedded in the magnetic resin carrier but part of the particles are fixed to protrude from the surface of the magnetic resin carrier.

When electrifiable particles are used as such particles, an organic or inorganic insulating material is used. Specifically, for example, organic insulating particles of polystyrene, styrene copolymer, acryl resin, various acryl copolymers, nylon, polyethylene, polypropylene, fluororesin, and cross-linked products of these substances are used. The material, polymerization catalyst, and surface processing of the organic insulating particles are appropriately selected to set an electrification level and polarity of the carrier as desired. As inorganic particles, negatively electrifiable inorganic particles such as silica and titanium bioxide, or positively electrifiable inorganic particles such as strontium titanate and alumina are used.

In the case of a binder carrier including a surface coating layer, silicone resin, acryl resin, epoxy resin, and fluororesin are used as a material to form the surface coating layer. Thus, the surface of the binder carrier is coated with the resin material and cured to form the surface coating layer so as to improve electrifiability.

The coat carrier includes carrier core particles of magnetic material that are coated with coat resin. In the case of the coat carrier, similarly to the binder carrier, positively or negatively electrifiable particles are fixed on the surface of the carrier. Electrification properties of the coat carrier such as the polarity are controlled by the kind of the surface coating layer and the kind of the electrifiable particles. The coat carrier is made of a material similar to the material of the binder carrier. Also, the carrier core particles are coated with a resin similar to the binder resin of the binder carrier.

Figure 4:
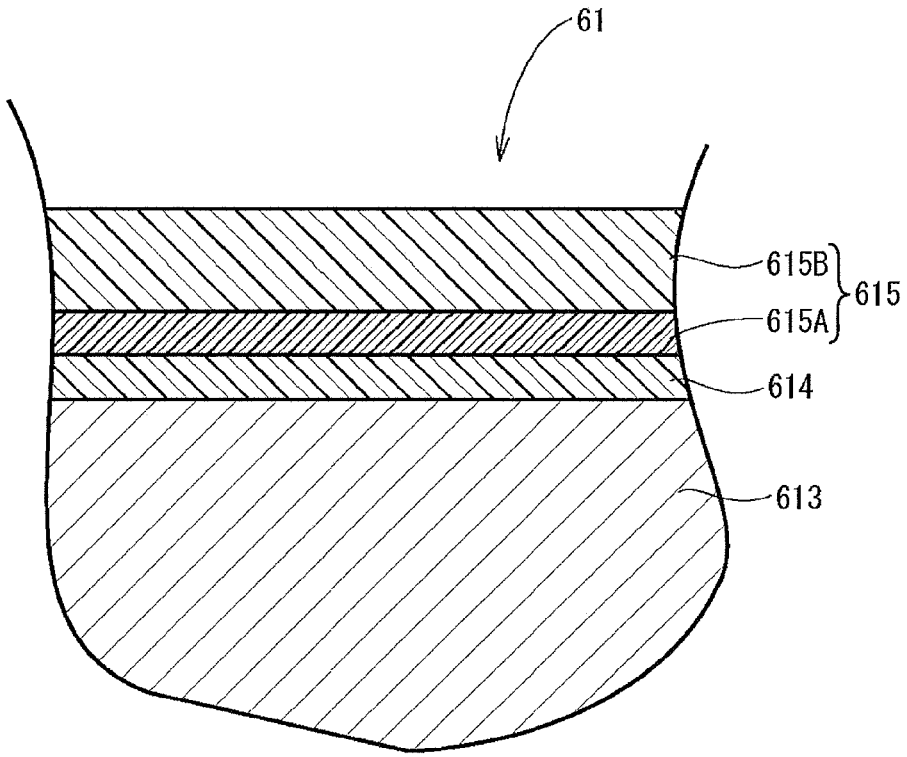
FIG. 4 is a partial cross-sectional view of a configuration of a photoconductive drum in the image forming apparatus shown in FIG. 1.

As shown in a partial cross-sectional view of FIG. 4, the photoconductive drum 61 includes an intermediate layer 614 and a photosensitive layer 615 that are laminated in sequence on an outer peripheral surface of a conductive support 613. The intermediate layer 614 has adhesiveness. An electrostatic latent image is formed on the photosensitive layer 615. The conductive support 613 is made of a conductive material. Examples include: metal such as aluminum, copper, chromium, nickel, zinc, and stainless steel that is molded in a drum or sheet shape; metal foil such as aluminum and copper that is laminated on a plastic film; aluminum, indium oxide, and tin oxide that is evaporated on a plastic film; and conductive matter singly or with binder resin applied to form a conductive layer.

The intermediate layer 614 has a barrier function in addition to the adhesion function to adhere the photosensitive layer 615 to the conductive support 613. The intermediate layer 614 is formed, for example, by dissolving a binder resin in a solvent and immersing the conductive support 613 in the solution. Examples of the binder resin include casein, polyvinyl alcohol, nitrocellulose, ethylene acrylate copolymer, polyamide, polyurethane, and gelatin. Among such binder resins, alcohol-soluble polyamide resin is preferable. As the solvent used for forming the intermediate layer 614, preferably, inorganic particles such as the above-described conductive particles and metal oxide particles are dispersed, and binder resin represented by polyamide resin is dissolved. Specifically, alcohol having carbon number of 2 to 4 such as ethanol, n-propyl alcohol, isopropyl alcohol, n-butanol, t-butanol, and sec-butanol is preferable. Such alcohol implements favorable solubility and coating performance with respect to polyamide resin. In order to improve preservability and dispersiveness of inorganic particles, co-solvent may be also used with the solvent. Examples of this co-solvent include methanol, benzyl alcohol, toluene, cyclohexanone, and tetrahydrofuran.

The density of the binder resin at the time of forming the coating solution is suitably selected in accordance with the thickness of the intermediate layer 614 and the coating method. When inorganic particles are dispersed in the binder resin, the mixing ratio of inorganic particles to the binder resin is preferably 20 to 400 weight % with respect to 100 weight % of the binder resin, and more preferably, 50 to 200 weight %. Examples of dispersing means of the inorganic particles include an ultrasonic disperser, a ball mill, a sand grinder, and a homomixer. After the binder resin is coated on the outer peripheral surface of the conductive support 613 and subjected to a drying step suitably selected from various drying methods such as heat drying, the intermediate layer 614 is formed. Preferably, the thickness of the intermediate layer 614 is 0.1 to 15 μm, and more preferably, 0.3 to 10 μm.

The photosensitive layer 615 on the surface of the photoconductive drum 61 includes a charge generation layer (CGL) 615A and a charge transport layer (CTL) 615B. The charge generation layer 615A has a charge generation function, and the charge transport layer 615B has a charge transport function. These layers are laminated to provide the photosensitive layer 615 with a layer configuration of separate functions. For this reason, an increase in residual potential owing to continuous use is controlled and suppressed to a low level. In addition, this facilitates control of various kinds of electrophotography properties in accordance of an object of use. When the photoconductive drum 61 has a negative electrification property, the charge generation layer 615A is laminated on the intermediate layer 614, and the charge transport layer 615B is further laminated on the charge generation layer 615A, as shown in FIG. 3. When the photoconductive drum 61 has a positive electrification property, the charge transport layer 615B is laminated on the intermediate layer 614, and the charge generation layer 615A is further laminated on the charge transport layer 615B. Preferably, the photosensitive layer 615 is a negative electrification photoconductor having the function separation configuration. However, the photosensitive layer 615 may have a single layer configuration including one layer of the charge generation function and the charge transport function.

The charge generation layer 615*a* of the photosensitive layer 615 contains a charge generation material and binder resin. Examples of the charge generation material include azo dye such as Sudan Red and diane blue, quinone pigment such as pyrene quinone and Anthanthrone, quinocyanine pigment, perylene pigment, indigo pigment such as indigo and thioindigo, and phthalocyanine pigment. Examples of the binder resin include polystyrene resin, polyethylene resin, polypropylene resin, acryl resin, methacryl resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, copolymer resin containing two or more of these resins (such as vinyl chloride-vinyl acetate copolymer resin, vinyl chloride-vinyl acetate-maleic anhydride copolymer resin), and polyvinylcarbazole resin.

In order to form the charge generation layer 615*a*, binder resin is dissolved in solvent, and the charge generation material is dispersed in the solution by a disperser to prepare coating solution. After coating a surface with the coating solution to have a uniform thickness by a coater, a coating film is dried to form the charge generation layer 615*a* as part of the photosensitive layer 615. As the solvent to form the charge generation layer 615*a*, examples include toluene, xylene, methyl ethyl ketone, cyclohexane, ethyl acetate, butyl acetate, methanol, ethanol, propanol, butanol, methyl cellosolve, ethyl cellosolve, tetrahydrofuran, 1-dioxane, 1,3-dioxolane, pyridine, and diethylamine.

Examples of the disperser of the charge generation material in the binder resin include an ultrasonic disperser, a ball mill, a sand grinder, and a homomixer. As for the mixing ratio of the charge generation material to the binder resin, preferably, 1 to 600 weight % of the charge generation material with respect to 100 weight % of the binder resin, and more preferably, 50 to 500 weight %. Preferably, the thickness of the charge generation layer 615*a* is 0.01 to 5 μm, and more preferably, 0.05 to 3 μm. It should be noted that foreign matter and agglomerates are filtered from the coating solution for the charge generation layer 615*a* prior to coating so as to prevent occurrence of image defects. The charge generation layer 615*a* is formed also by vacuum evaporation of pigment as the charge generation material.

The charge transport layer 615*b* contains a charge transport material and binder resin. Examples of the charge transport material include a single compound or a mixture of two or more compounds such as carbazole derivative, oxazole derivative, oxadiazole derivative, thiazole derivative, thiadiazole derivative, triazole derivative, imidazole derivative, imidazolone derivative, imidazolidine derivative, bis-imidazolidine derivative, styryl compound, hydrazone compound, pyrazoline compound, oxazolone derivative, benzimidazolone derivative, quinazoline derivative, benzofuran derivative, acridine derivative, phenazine derivative, aminostilbene derivative, triarylamine derivative, phenylenediamine derivative, stilbene derivative, benzidine derivative, poly-N-vinylcarbazole, poly-1-vinylpyrene, and poly-9-vinyl anthracene.

Examples of the binder resin for the charge transport layer 615*b* include polycarbonate resin, polyacrylate resin, polyester resin, polystyrene resin, styrene-acrylonitrile copolymer resin, polymethacrylic acid-ester resin, and styrene-methacrylic acid ester copolymer resin. Of these resin materials, polycarbonate resin is preferable. In consideration of crack resistance, abrasion resistance, and electrification properties, polycarbonate resin such as bisphenol A (BPA), bisphenol Z (BPZ), dimethyl BPA, BPA-dimethyl BPA copolymer is more preferable.

Similarly to the charge generation layer 615*a*, the charge transport layer 615*b* is formed by the coating method with the solvent described above. Concerning the mixing ratio of the binder resin and the charge transport material, preferably, the charge transport material is 10 to 500 weight % with respect to 100 weight % of the binder resin, and more preferably, 20 to 100 weight %. The thickness of the charge transport layer 615*b* is preferably 5 to 60 μm, and more preferably, 10 to 40 μm. Antioxidant may be added to the charge transport layer 615*b*. For example, antioxidant disclosed in Japanese Unexamined Patent Application Publication No. 2000-305291 may be used.

As described above, the intermediate layer 614, the charge generation layer 615*a*, and the charge transport layer 615*b*, which constitute the photoconductive drum 61, are respectively formed on the outer peripheral surface of the conductive support 613 by a conventional coating method. Specifically, examples of the conventional coating method include dip coating, spray coating, spinner coating, bead coating, blade coating, beam coating, and circular amount-restriction coating. The coating method for each of the layers of the photoconductive drum 61 will not be limited to one kind. A plurality of coating methods may be combined or coating may be performed a plurality of times.

<Electrification Control Block>

Figure 5:
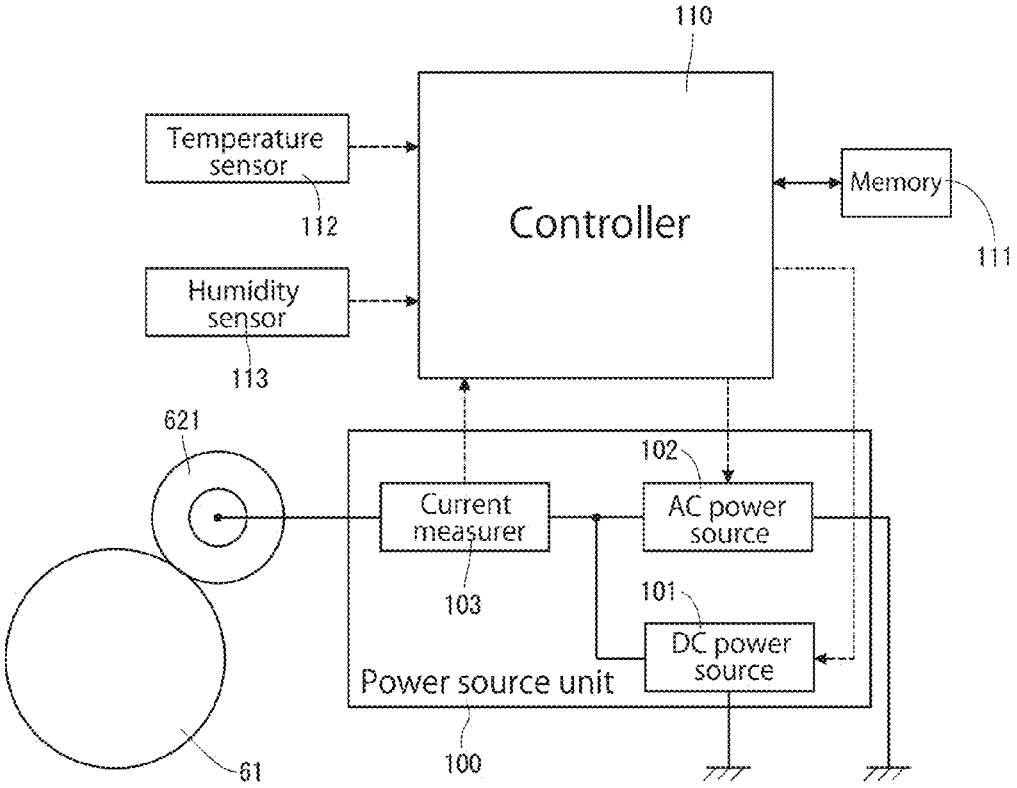
FIG. 5 is a block diagram illustrating a configuration of an electrification control block in the image forming apparatus shown in FIG. 1.

In the image formation portion 51 having the above-described configuration, the electrifier 62 electrifies the surface of the photoconductive drum 61 uniformly. For this purpose, as shown in FIG. 5, a voltage having an AC voltage superposed on a DC voltage is applied to the electrification roller 621 by a power source unit 100. The power source unit 100 includes a DC power source 101, an AC power source 102, and a current measurer 103. The DC power source 101 applies a DC voltage Vg serving as an electrifying voltage to electrify the photoconductive drum 61. The AC power source 102 superposes the AC voltage on the DC voltage Vg of the DC power source 101. The current measurer 103 measures a value of current passing the electrification roller 621.

A controller 110 controls each component of the apparatus main body 2. In order to set application voltage to the electrifier 62, the controller 110 gives control signals to the power source unit 100. The controller 110 sets the DC voltage Vg by the DC power source 101 and a peak-to-peak voltage Vpp of the AC voltage by the AC power source 102. Thus, the application voltage to the electrifier 62 is set. The controller 110 detects the minimum value Vth of the peak-to-peak voltage Vpp discharged between the photoconductive drum 61 and the electrification roller 621 at a predetermined timing (hereinafter referred to as "discharge starting voltage"). The controller 110 sets a peak-to-peak voltage of the AC voltage applied to the electrifier 62 by the AC power source 102 (hereinafter referred to as "electrification voltage").

In detection of the discharge starting voltage, the controller 110 sets application voltage for measuring the discharge starting voltage (hereinafter referred to as "measurement voltage") based on values of measurement by a temperature sensor 112 and a humidity sensor 113 (environment detectors) to measure temperature and humidity environment inside of the apparatus main body 2. Then, the controller 110 refers to data tables stored in a memory 111, and changes the peak-to-peak voltage of the AC voltage by the AC power source 102 in stages from low voltage to high voltage. Also, the controller 110 receives a current value measured by the current measurer 103, and detects a value of alternating current passing the photoconductive drum 51 and the electrification roller 621.

When the AC voltage from the AC power source 102 is lower than the discharge starting voltage, the controller 110 detects a current value of nip current based on contact resistance between the electrification roller 621 and the photoconductive drum 61. When the AC voltage from the AC power source 102 is higher than the discharge starting voltage, the controller 110 detects a current value by adding discharge current between the photoconductive drum 61 and the electrification roller 621 to the nip current between the photoconductive drum 61 and the electrification roller 621. The controller 110 changes the AC voltage from the AC power source, and measures the current value in the above-described manner. Based on the measured current value, the controller 110 calculates and store a discharge starting voltage Vth in the memory 111.

When performing printing operation of the above-described image forming apparatus 1, the controller 110 sets an electrification voltage Vac from the AC power source 102 based on the discharge starting voltage Vth stored in the memory 111 and the temperature and humidity environment inside of the apparatus main body 2 measured by the temperature sensor 112 and the humidity sensor 113. Therefore, the controller 110 gives control signals to the power source unit 100 to output, from the AC power source 102, an AC voltage (AC voltage having an amplitude Vac/2) from the set electrification voltage Vac and to output a DC voltage Vg from the DC power source 101 at the same time. Thus, the power source unit 100 outputs an AC voltage having an amplitude Vac/2 (AC voltage of Vg±Vac/2) with DC voltage Vg from the DC power source 101 as central voltage, and applies the AC voltage to the electrification roller 621.

Concerning the electrifying voltage to be applied to the electrification roller 621 corresponding to each of the colors Y, M, C, and K, the controller 110 may execute the above-described operation of setting the electrification voltage. Thus, with respect to the electrification rollers 621 of the colors Y, M, C, and K, the electrifying voltage is set in accordance with states of the corresponding photoconductive drums 61. The following embodiments have the configuration and operation described above in common, and are characterized in detection operation of the discharge starting voltage. Therefore, in the following embodiments, the detection operation of the discharge starting voltage by the controller 110 will be mainly described.

First Embodiment

Figure 7:
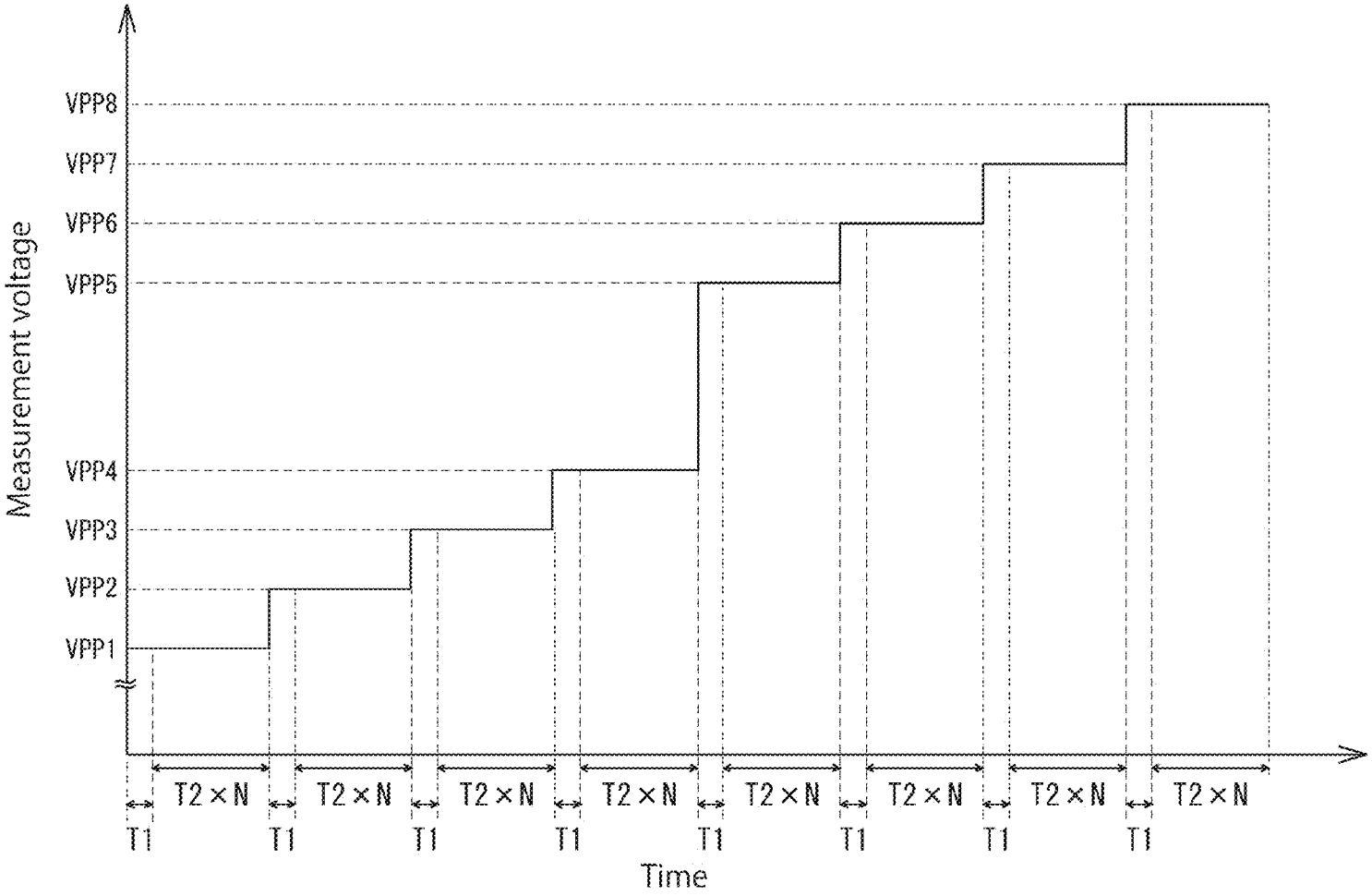
FIG. 7 is a timing chart illustrating transition timings of voltage for measurement in the first measurement of current values for calculating discharge starting voltage.
Figure 8:
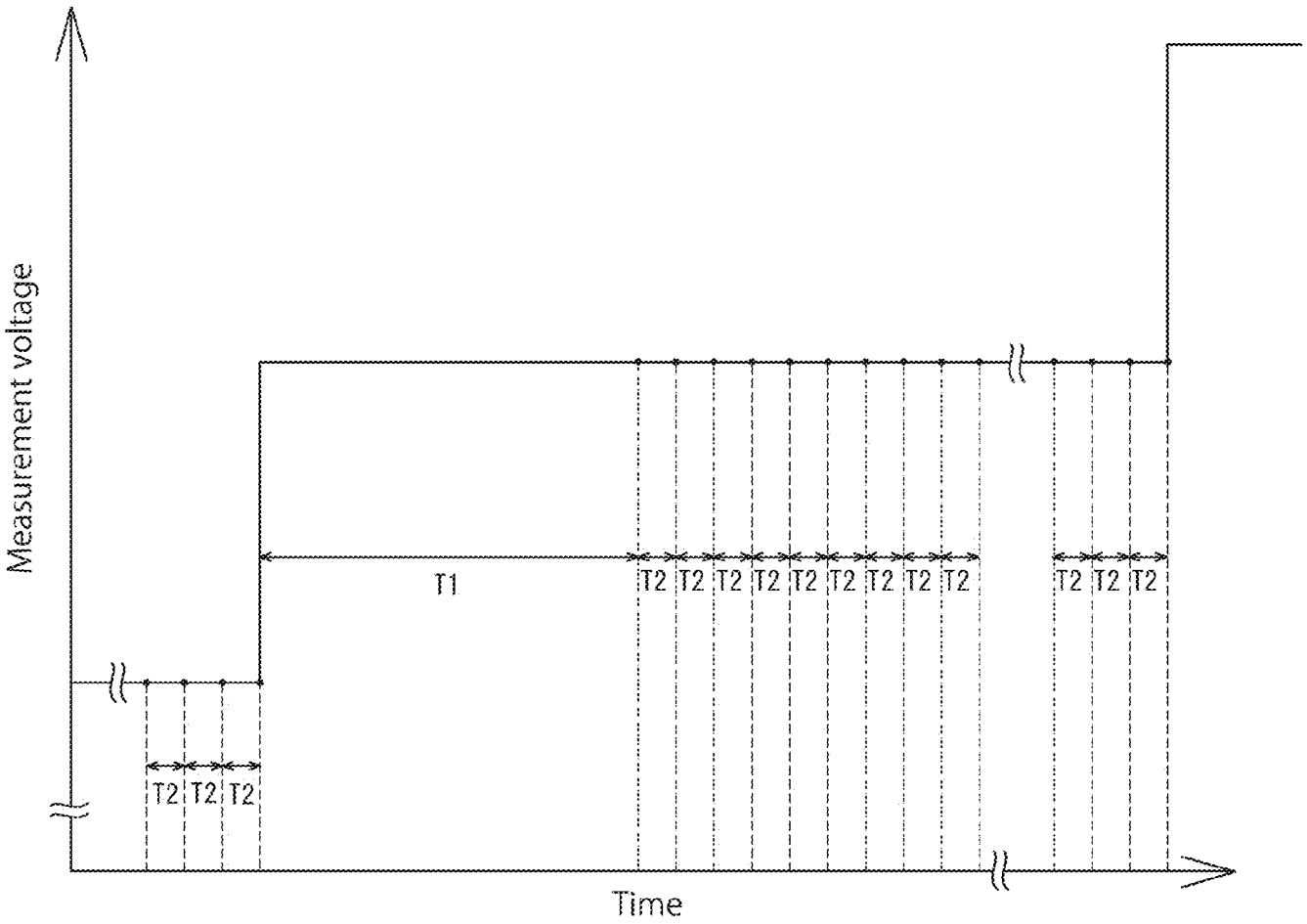
FIG. 8 is an enlarged view of part of the timing chart shown in FIG. 7.
Figure 9:
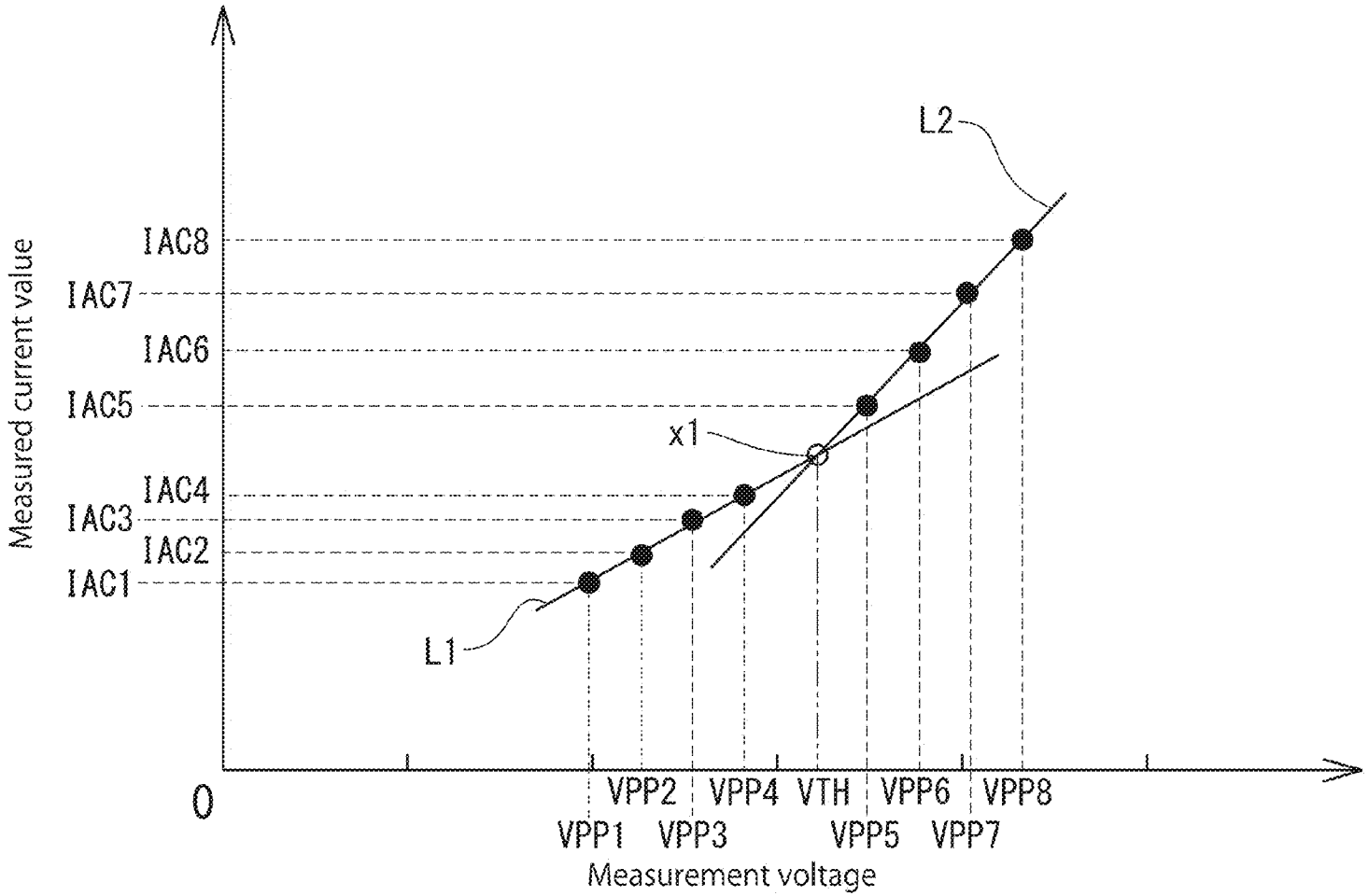
FIG. 9 is a graph illustrating a relationship between voltage for measurement and measured current values for describing a calculation method of the discharge starting voltage in the first measurement.

An image forming apparatus according to a first embodiment of the present invention will be described below with reference to the drawings. FIG. 6 is a diagram illustrating a configuration of tables stored in a memory in the image forming apparatus according to the first embodiment. FIGS. 7 and 8 are timing charts illustrating transition timings of measurement voltage in current value measurement for calculating discharge starting voltage. FIG. 9 is a graph illustrating a relationship between measurement voltage and measured current values and is used for describing a method for calculation of discharge starting voltage.

In the image forming apparatus 1 according to the first embodiment, as shown in FIG. 6, the memory 111 stores a measurement voltage setting table (first setting table) DT1, a discharge starting voltage correction table (first correction table) DT2, a measurement voltage correction table (second correction table) DT3, and a measurement voltage setting table (second setting table) DT4. The first setting table DT1 stores measurement voltages Vpp corresponding to environment values of the apparatus main body 2 (temperature and humidity inside of the apparatus). The first correction table DT2 stores discharge starting voltage correction values (first correction values) Vx for correcting discharge starting voltage Vth calculated by the controller 110. The second correction table DT3 stores reference voltage correction values (second correction values) Vy for setting reference values Vpp0 of measurement voltage Vpp of the second and subsequent measurement. The second setting table DT4 is used for setting the measurement voltage Vpp of the second and subsequent measurement.

In addition to a table storage area storing the above-described tables DT1 to DT4, the memory 111 includes a setting value storage area and a calculation area. The setting value storage area stores the discharge starting voltage Vth and the electrification voltage Vac acquired by the controller 110. The calculation area is for calculating the discharge starting voltage Vth and the electrification voltage Vac in the controller 110. It should be noted that the memory 111 may include all of the table storage area, the setting value storage area, and the calculation area, and also, individual memories may be respectively provided for the corresponding areas.

The image forming apparatus 1 provided with the memory 111 starts measurement operation of discharge starting voltage Vth by the controller 110 at predetermined timings. The predetermined timings include when the power of the apparatus main body 2 is switched on, when printing exceeds the predetermined number of sheets (for example, when 500 or more sheets are printed continuously), and when a change amount of the environment value of the apparatus main body 2 exceeds a threshold. When the controller 110 confirms that measurement operation is performed for the first time, the controller 110 receives environment values (temperature and humidity inside of the apparatus) respectively measured by the temperature sensor 112 and the humidity sensor 113. Also, the controller 110 retrieves measurement voltages Vpp1 to Vpp8 corresponding to the environment values from the first setting table DT1. Specifically, the measurement voltages Vpp1 to Vpp8 are set to be, with respect to Vpp1 corresponding to an environment value Sn, Vpp2=Vpp1+ΔV1, Vpp3=Vpp2+ΔV1, Vpp4=Vpp3+ΔV1, Vpp5=Vpp4+ΔV2 (ΔV2>ΔV1), Vpp6=Vpp5+ΔV1, Vpp7=Vpp6+ΔV1, and Vpp8=Vpp7+ΔV1.

In the example shown in FIG. 6, ΔV1=100 V and ΔV2=300 V. With respect to environment values S1 to S4, Vpp1 is respectively set to be 1300V, 1200V, 1100V, and 1000V. When the temperature and the humidity inside of the apparatus are the lowest, the measurement voltages Vpp1 to Vpp8 are set to be values corresponding to the environment values S1. When the temperature and the humidity inside of the apparatus are the highest, the measurement voltages Vpp1 to Vpp8 are set to be values corresponding to the environment values S4. When the temperature and the humidity inside of the apparatus are in a normal range, the measurement voltages Vpp1 to Vpp8 are set to be values corresponding to the environment values S3. Of the environment values S1 to S4, an environment value denoted by a small number represents an environment inside of the apparatus in which the resistance of the electrification roller 621 is high, and an environment value denoted by a large number represents an environment inside of the apparatus in which the resistance of the electrification roller 621 is low.

When the controller 110 sets the measurement voltages Vpp1 to Vpp8 in this manner, the controller 110 sends control signals to the power source unit 100 to change peak-to-peak voltage of the AC voltage supplied from the AC power source 102 in stages from the measurement voltage Vpp1 at the minimum to the measurement voltage Vpp8 at the maximum. Then, the controller 110 superposes the AC voltage on DC voltage Vg from the DC power source 101. Specifically, as shown in FIG. 7, when the controller 110 starts measurement operation, the AC voltage from the AC power source 102 is set as a measurement voltage Vpp1. When a predetermined period of time T1 (for example, 100 msec) elapses after the AC voltage from the AC power source 102 is set as the measurement voltage Vpp1, the controller 110 acquires a current value measured by the current measurer 103. When the controller 110 starts acquisition of the measured current value, as shown in FIGS. 7 and 8, the controller 110 receives measured current values from the current measurer 103 N times (for example, 120 times) continuously at intervals of a predetermined period of time T2 (for example, 5 msec).

Acquiring the measured current values of N times at the measurement voltage Vpp1, the controller 110 calculates an average value Iac1 of the acquired measured current values. At the same time, as shown in FIG. 7, the controller 110 changes the peak-to-peak voltage of the AC voltage supplied from the AC power source 102 to a measurement voltage Vpp2. When the predetermined period of time T1 elapses after the change to the measurement voltage Vpp2, as shown in FIGS. 7 and 8, the controller 110 receives measured current values from the current measurer 103 N times continuously at intervals of the predetermined period of time T2. Then, the controller 110 calculates an average value Iac2 of the acquired measured current values of N times, and at the same time, the controller 110 changes the peak-to-peak voltage of the AC voltage supplied from the AC power source 102 to a measurement voltage Vpp3.

At intervals of a period of time T1+T2×N, the controller 110 changes the peak-to-peak voltage of the AC voltage supplied from the AC power source 102 in stages from the measurement voltage Vpp3 to a measurement voltage Vpp8. The controller 110 respectively calculates average values Iac3 to Iac8 of the measured current values of N times at the measurement voltages Vpp3 to Vpp8. It should be noted that the interval T2 of acquisition of the measured current value is set based on resolution of the measured current value. The number N of acquisitions of the measured current values is set at such a value that the electrification roller 621 rotates one turn or more in a period of time T2×N.

As described above, the controller 110 respectively calculates the average values Iac1 to Iac8 of the measured current values at the measurement voltages Vpp1 to Vpp8. Based on a relationship between the measurement voltages Vpp1 to Vpp8 and the average measured current values Iac1 to Iac8, as shown in FIG. 9, the controller 110 calculates a discharge starting voltage Vth. Specifically, referring to the measurement voltages Vpp1 to Vpp4 as pre-discharge voltages, and based on a relationship between the pre-discharge voltages and the average measured current values Iac1 to Iac4, the controller 110 acquires a line L1 representing a relationship between electrifying voltage and nip current by the least squares method. Also, referring to the measurement voltages Vpp5 to Vpp8 as post-discharge voltages, and based on a relationship between the post-discharge voltages and the average measured current values Iac5 to Iac8, the controller 110 acquires a line L2 representing a relationship of electrifying voltage, nip current, and discharge current by the least squares method.

As described above, based on the measurement voltages Vpp1 to Vpp8 and the average measured current values Iac1 to Iac4, the controller 110 acquires the lines L1 and L2 in the graph of FIG. 9. Then, the controller 110 calculates an electrifying voltage at an intersection X1 of the acquired lines L1 and L2, and assumes the calculated electrifying voltage at the intersection X1 as a discharge starting voltage Vth. After calculating the discharge starting voltage Vth, the controller 110 refers to the first correction table DT2 and retrieves a first correction value Vx based on the environment value Sn. The discharge starting voltage Vth is corrected by the first correction value Vx. The resultant value Vth+Vx is assumed as an environment-correction discharge starting voltage Vth1[1] and stored in the memory 111. In the first correction table DT2 in the example of FIG. 6, the first correction value Vx with respect to the environment value S1 is −200 V, the first correction value Vx with respect to the environment value S2 is −100 V, and the first correction value Vx with respect to the environment values S3 and S4 is 0 V.

Based on the calculated environment-correction discharge starting voltage Vth1[1], the controller 110 sets a peak-to-peak voltage of the AC voltage from the AC power source 102 as an electrification voltage Vac. This electrification voltage Vac is a voltage value to cause discharge between the photoconductive drum 61 and the electrification roller 621. The electrification voltage Vac may be a voltage value Vth1[1]+ΔV, which is the sum of the environment-correction discharge starting voltage Vth1[1] and a predetermined voltage ΔV. Also, the electrification voltage Vac may be a voltage value K×Vth1[1], which is the product of the environment-correction discharge starting voltage Vth1[1] and a predetermined coefficient K (K>1). The controller 110 stores the set electrification voltage Vac in the memory 111, and also controls the AC power source 102 to apply the AC voltage having the set electrification voltage Vac as the peak-to-peak voltage to the electrification roller 621.

As described above, in the first measurement operation, the controller 110 refers to the first setting table DT1 and the first correction table DT2 to calculate the environment-correction discharge starting voltage Vth1[1] in accordance with the environment value Sn and to set the electrification voltage Vac. In the second and subsequent measurement operation, the controller 110 refers to the second correction table DT3 and the second setting table DT4 and uses the environment-correction discharge starting voltage Vth1[*n*−1], which has been acquired in the previous measurement operation, and the environment value Sn. Thus, the controller 110 calculates the environment-correction discharge starting voltage Vth1[*n*] and sets the electrification voltage Vac.

In the second and subsequent measurement operation, the controller 110 retrieves the previous environment-correction discharge starting voltage Vth1[*n*−1] stored in the memory 111, which is assumed as a previous measurement voltage Vth2[*n*]. Then, the controller 110 receives the environment values Sn respectively measured by the temperature sensor 112 and the humidity sensor 113. Referring to the second correction table DT3 of the memory 111, the controller 110 retrieves second correction values Vy corresponding to the environment values Sn and adds the second correction values Vy to the previous measurement voltage Vth2[*n*]. Thus, a reference value Vpp0 (=Vth2[*n*]+Vy) of the measurement voltage Vpp is calculated. In the second correction table DT3 in the example of FIG. 6, the second correction value Vy with respect to the environment value S1 is +200 V, the second correction value Vy with respect to the environment value S2 is +100 V, and the second correction value Vy with respect to the environment values S3 and S4 is 0 V.

After calculating the measurement voltage reference value Vpp0, the controller 110 refers to the second setting table DT4 and acquires measurement voltages Vpp1*a* to Vpp4*a* having a relationship Vpp1*a*<Vpp2*a*<Vpp0<Vpp3*a*<Vpp4*a*. The measurement voltage Vpp1*a* is set to be Vpp0−ΔV1*a* by subtracting a voltage ΔV1*a* from the reference value Vpp0. The measurement voltage Vpp2*a* is set to be Vpp0−ΔV2*a* (ΔV1*a*>ΔV2*a*) by subtracting a voltage ΔV2*a* from the reference value Vpp0. The measurement voltage Vpp3*a* is set to be Vpp0+ΔV3*a* by adding a voltage ΔV3*a* to the reference value Vpp0. The measurement voltage Vpp4*a* is set to be Vpp0+ΔV4*a* (ΔV4*a*>ΔV3*a*) by adding a voltage ΔV4*a* to the reference value Vpp0. In the example of FIG. 6, with the measurement voltage reference value Vpp0 being a central value, ΔV1*a*=ΔV4*a*=200 V, and ΔV2*a*=ΔV3*a*=100 V.

Figure 10:
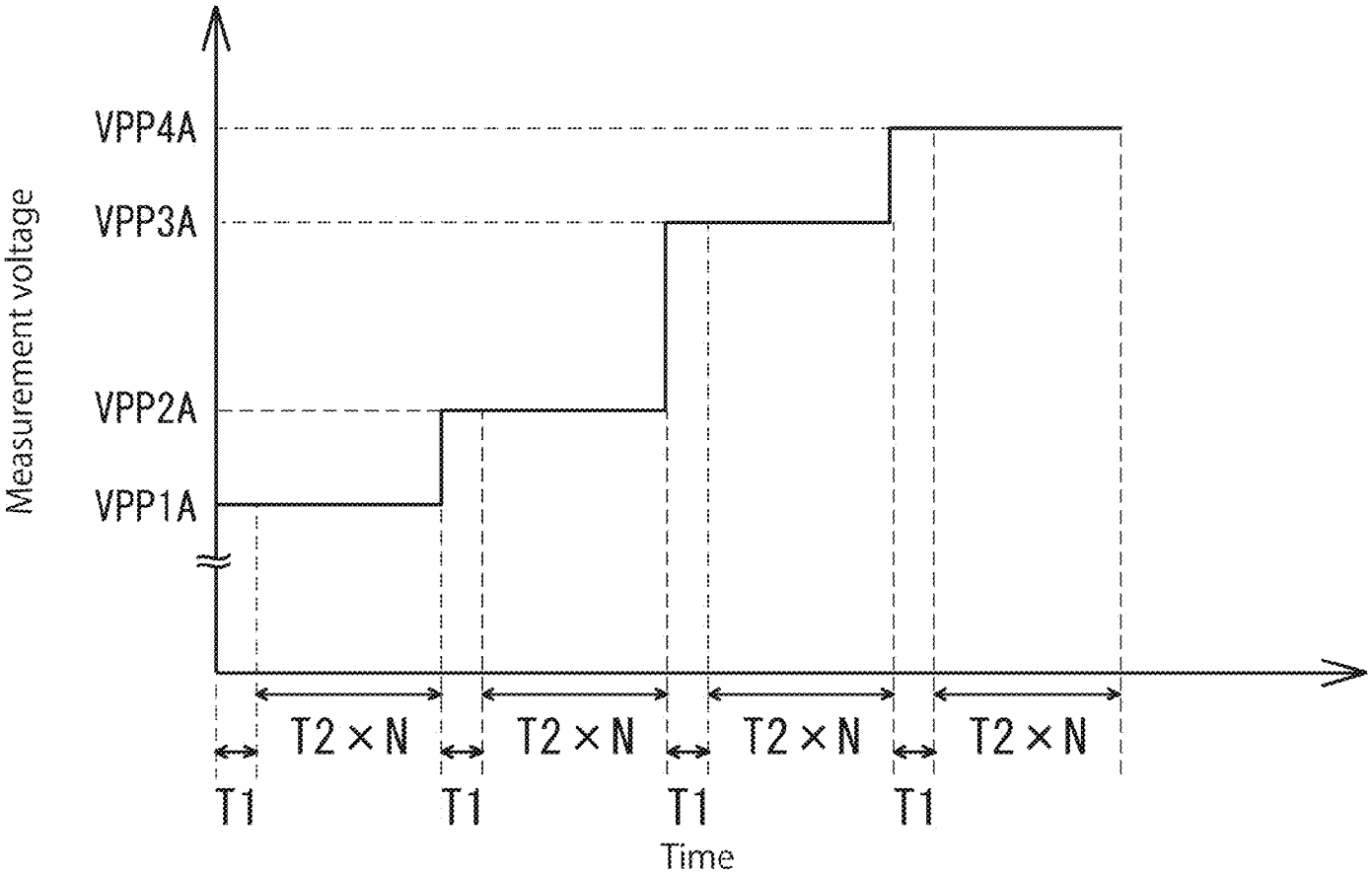
FIG. 10 is a timing chart illustrating transition timings of voltage for measurement in the second and subsequent measurement of current values for calculating the discharge starting voltage.

The controller 110 sets the measurement values Vpp1*a* and Vpp2*a* as two pre-discharge voltages and the measurement values Vpp3*a* and Vpp4*a* as two post-discharge voltages. Then, as shown in FIG. 10, in sequence from the measurement value Vpp1*a*, the peak-to-peak voltage of the AC voltage supplied from the AC power source 102 is changed. Each time the controller 110 changes the measurement value, the controller 110 executes measurement operation similar to the first measurement operation. That is, when the predetermined period of time T1 elapses immediately after the change of the measurement value, the controller 110 acquires measured current values by the current measurer 103 N times continuously at intervals of the period of time T2. Also, similarly to the first measurement operation, the controller 110 calculates average values Iac1*a* to Iac4*a* of the acquired measured current values of N times with respect to the respective measurement voltages Vpp1*a* to Vpp4*a*.

As described above, the controller 110 respectively calculates the average values Iac1*a* to Iac4*a* of the measured current values at the measurement voltages Vpp1*a* to Vpp4*a*. Then, based on the relationship shown in FIG. 11, the controller 110 calculates a discharge starting voltage Vth. Specifically, based on a relationship between the measurement voltages Vpp1*a* and Vpp2*a* as the pre-discharge voltages and the average measured current values Iac1*a* and Iac2*a*, the controller 110 acquires a line L1*a* representing a relationship between electrifying voltage and nip current by the least squares method. Also, based on a relationship between the measurement voltages Vpp3*a* and Vpp4*a* as the post-discharge voltages and the average measured current values Iac3*a* and Iac4*a*, the controller 110 acquires a line L2*a* representing a relationship of electrifying voltage, nip current, and discharge current by the least squares method.

Figure 11:
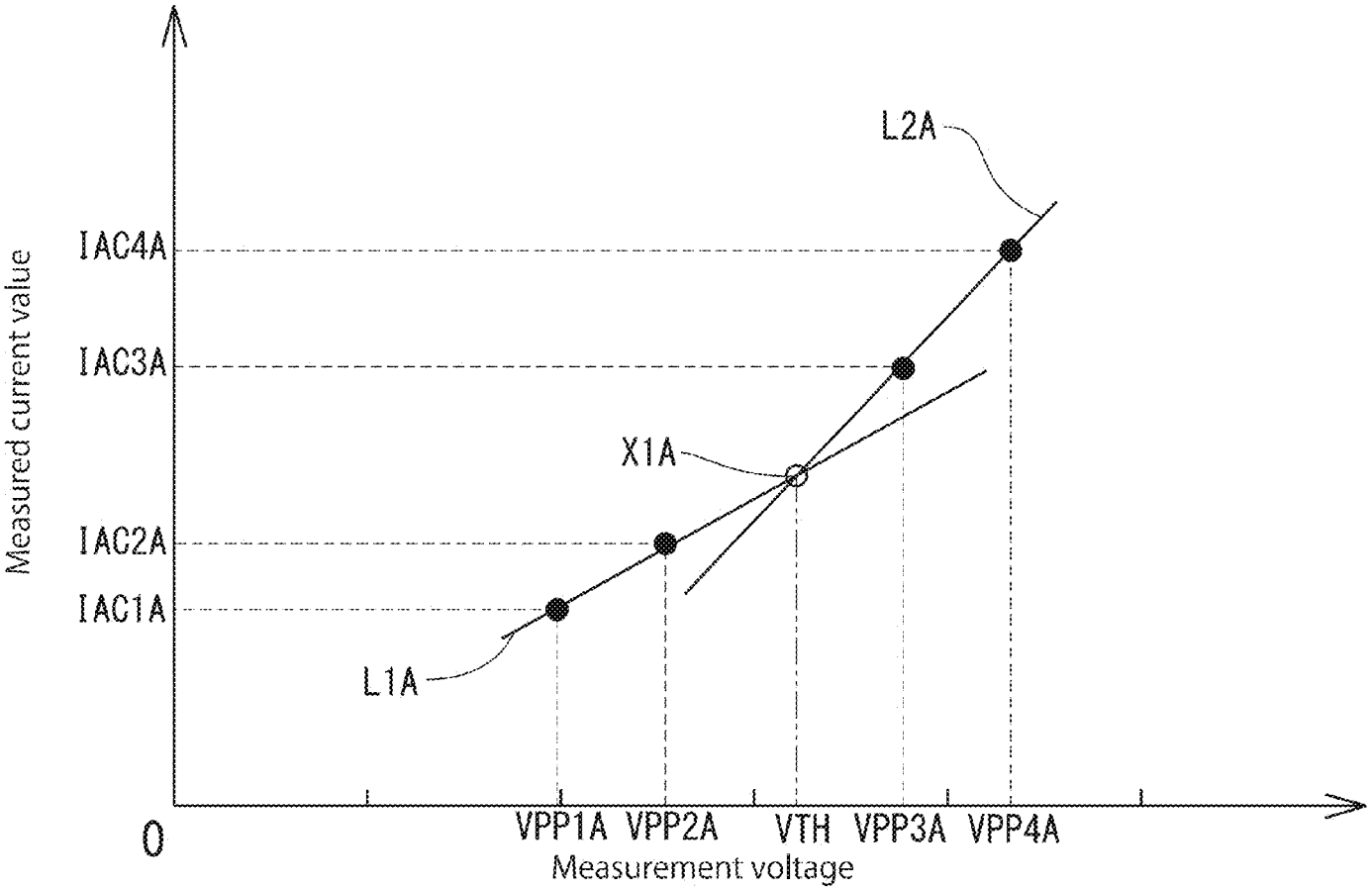
FIG. 11 is a graph illustrating a relationship between voltage for measurement and measured current values for describing a calculation method of the discharge starting voltage in the second and subsequent measurement.

Then, the controller 110 calculates an electrifying voltage at an intersection X1*a* of the lines L1*a* and L2*a* in the graph of FIG. 11, and assumes the electrifying voltage as a discharge starting voltage Vth. After calculating the discharge starting voltage Vth, the controller 110 refers to the first correction table DT2 and retrieves a first correction value Vx based on the environment value Sn. The discharge starting voltage Vth is corrected by the first correction value Vx, and the resultant value Vth+Vx is assumed as an environment-correction discharge starting value Vth1[*n*] and stored in the memory 111. Further, based on the calculated environment-correction discharge starting value Vth1[*n*], the controller 110 sets an electrification voltage Vac that is a peak-to-peak voltage of the AC voltage from the AC power source 102 and controls application operation by the power source unit 100.

Thus, in the second and subsequent measurement operation, two measurement points are set for each of the pre-discharge voltage and the post-discharge voltage. Consequently, in a period of time shorter than the first measurement operation, the electrification voltage Vac that is a peak-to-peak voltage of the AC voltage from the AC power source 102 is set. It should be noted that in the second and subsequent measurement operation, the number of measurement points at the pre-discharge voltage and the post-discharge voltage should be smaller than the number of the measurement points in the first measurement operation. For example, when the number of measurement points in the first measurement operation is Y1, the number of measurement points in the second and subsequent measurement operation should be two or more and (Y1−1) or less.

In the first embodiment, in the second and subsequent measurement operation, the second correction value Vy corresponding to the environment value Sn is retrieved and added to the previous measurement voltage Vth2[*n*] (=Vth1[*n*−1]) so as to calculate the measurement voltage reverence value Vpp0. However, in the third and subsequent measurement operation, not only the previous measurement voltage Vth2[*n*] but also the second previous measurement voltage Vth3[*n*] (=Vth1[*n*−2]) may be used for calculation. Specifically, in the third and subsequent measurement operation, for example, the second correction value Vy is added to the previous measurement voltage Vth2[*n*] to calculate a first reference value Vpp0*a* (=Vth2[*n*]+Vy). The second correction value Vy is added to the second previous measurement voltage Vth3[*n*] to calculate a second reference value Vpp0*b* (=Vth3[*n*]+Vy). Then, an average value of the first and second reference values Vpp0*a* and Vpp0*b* may be assumed as a measurement voltage reference value Vpp0. A weighted average value of the first and second reference values Vpp0*a* and Vpp0*b* may be assumed as a measurement voltage reference value Vpp0.

Moreover, as described above, in the third and subsequent measurement operation, the previous two environment-correction discharge starting voltages are used to calculate the measurement voltage reference value Vpp0. In this manner, in each measurement operation, a plurality of environment-correction discharge starting voltages may be stored as a history, and the stored history may be used to calculate the measurement voltage reference value Vpp0. In order to calculate the measurement voltage reference value Vpp0, all the history of the environment-correction discharge starting voltages stored in the memory 111 may be retrieved. Also, the predetermined number of environment-correction discharge starting voltages, for example, previous three, may be retrieved.

Second Embodiment

Figure 12:
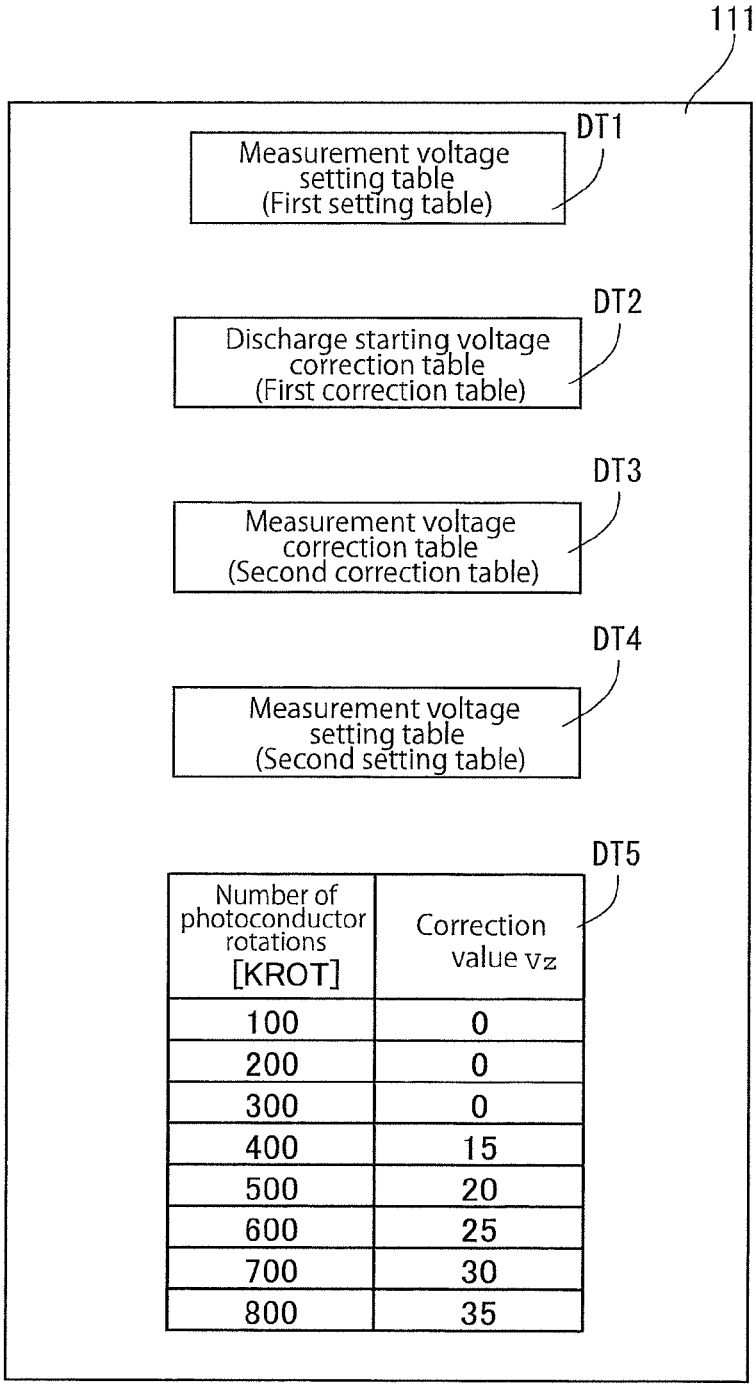
FIG. 12 is a schematic diagram illustrating a configuration of a memory in an image forming apparatus according to a second embodiment.

An image forming apparatus according to a second embodiment of the present invention will be described below with reference to the drawings. FIG. 12 is a diagram illustrating a configuration of tables stored in a memory in the image forming apparatus according to the second embodiment. In the second embodiment, the same components and operations as in the first embodiment will be denoted by the same reference numerals and will not be elaborated here.

In the image forming apparatus 1 according to the second embodiment, as shown in FIG. 12, similarly to the first embodiment (see FIG. 6), the memory 111 stores a measurement voltage setting table (first setting table) DT1, a discharge starting voltage correction table (first correction table) DT2, a measurement voltage correction table (second correction table) DT3, and a measurement voltage setting table (second setting table) DT4. The memory 111 further stores an electrification voltage correction table (third correction table) DT5 storing electrification voltage correction values (third correction values) Vz for correcting an electrification voltage Vac in accordance with the number of rotations of the photoconductive drum 61.

In the image forming apparatus 1 according to the second embodiment, similarly to the first embodiment, the controller 110 changes a peak-to-peak voltage of the AC voltage superposed on a DC voltage Vg at each predetermined timing to execute measurement operation of a discharge starting voltage Vth. In the first measurement operation, the controller 110 refers to the first setting table DT1, and based on a measurement result in operating the power source unit 100, the controller 110 calculates the discharge starting voltage Vth (see FIG. 9). In the second and subsequent measurement operation, the controller 110 refers to the second correction table DT3 and the second setting table DT4, and based on a measurement result in operating the power source unit 100, the controller 110 calculates the discharge starting voltage Vth (see FIG. 11).

Then, similarly to the first embodiment, referring to the first correction table DT2, the controller 110 corrects the acquired discharge starting voltage Vth in accordance with the environment value Sn and calculates an environment-correction discharge starting voltage Vth1[*n*]. The controller 110 stores the acquired environment-correction discharge starting voltage Vth1[*n*] in the memory 111. Also, based on the environment-correction discharge starting voltage Vth1[*n*], the controller 110 sets an electrification voltage Vac that is a peak-to-peak voltage of the AC voltage from the AC power source 102.

Figure 13:
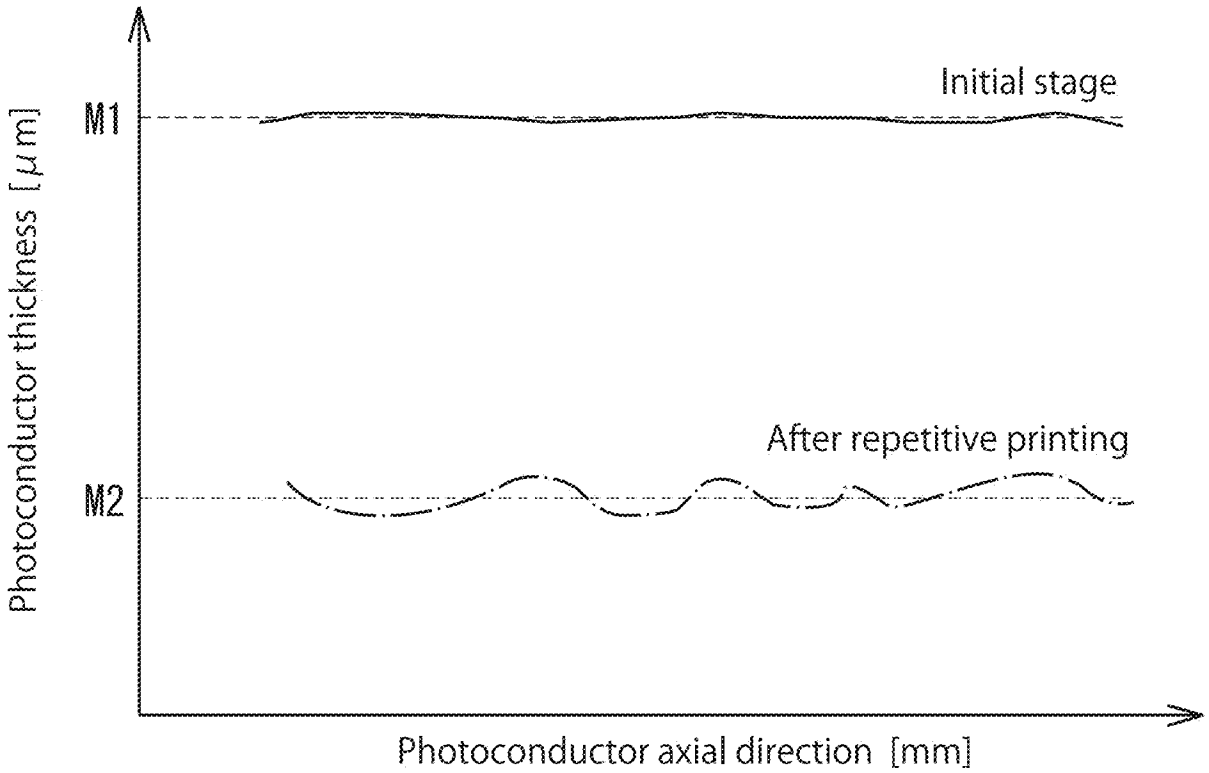
FIG. 13 is a graph illustrating a state of thickness of a photosensitive layer in an axial direction of the photoconductive drum.

Of the photoconductive drum 61, as indicated by the solid line in the graph of FIG. 13, the thickness of the photosensitive layer 615 in an initial state is M1 μm and approximately uniform in an axial direction of the photoconductive drum 61. However, when the photoconductive drum 61 rotates in an operation of the image forming apparatus 1 such as printing, the surface of the photoconductive drum 61 is abraded. Consequently, as the number of rotations of the photoconductive drum 61 increases, the thickness of the photosensitive layer 615 is reduced. At positions on the surface of the photoconductive drum 61, amounts of accumulated toner are different in accordance with an image to be formed. For such a reason, as indicated by the dot-dash line in the graph of FIG. 13, when the average thickness of the photosensitive layer 615 is reduced to a thickness M2 (M2<M1) μm, the thickness of the photosensitive layer 615 lacks uniformity in the axial direction of the photoconductive drum 61.

In other words, as the number of rotations of the photoconductive drum 61 increases, the thickness of the photosensitive layer 615 decreases, and at the same time, the thickness of the photosensitive layer 615 becomes uneven in the axial direction of the photoconductive drum 61. When the electrification voltage Vac set as described above is applied to the electrification roller 621 at the time of image formation (printing processing), unevenness (deviation) of the thickness of the photosensitive layer 615 on the photoconductive drum 61 causes defective electrification at a portion of the photosensitive layer 615 increased in thickness.

In the second embodiment, at the time of image formation (printing processing), the controller 110 predicts the thickness deviation of the photosensitive layer 615 from the number of rotations of the photoconductive drum 61, and corrects the electrification voltage Vac at the time of image formation (printing processing) in accordance with the maximum thickness of the photosensitive layer 615 on the photoconductive drum 61. Consequently, in the image formation, the controller 110 notifies the power source unit 100 of the electrification voltage Vac1 corrected in accordance with the thickness deviation of the photoconductive drum 61. Thus, the AC voltage applied to the electrification roller 621 by the power source unit 100 has a dischargeable amplitude Vac1/2 even at a portion of the photosensitive layer 615 on the photoconductive drum 61 that has the maximum thickness.

The correction processing of the electrification voltage Vac in the image formation will now be described. When the printing processing (image formation) starts, the controller 110 confirms the number of rotations of the photoconductive drum 61. At this time, for example, the controller 110 measures operation time of a motor (not shown) to give torque to the photoconductive drum 61 and the rotation rate of the motor. The operation time and the rotation rate of the motor, and the drum diameter of the photoconductive drum 61 are used for calculation to acquire the number of rotations of the photoconductive drum 61. This number of rotations of the photoconductive drum 61 may be stored in the memory 111 each time the calculation is executed by the controller 110.

The controller 110 refers to the third correction table DT5 in the memory 111, and based on the acquired number of rotations of the photoconductive drum 61, the controller 110 acquires a third correction value Vz, and retrieves the electrification voltage Vac stored in the memory 111. In the third correction table DT5 in the example of FIG. 12, when the number of rotations of the photoconductive drum 61 is less than 400,000 rotations (400 krot), the third correction value Vz is 0 V. When the number of rotations of the photoconductive drum 61 is equal to or more than 400,000 rotations, the third correction value Vz is 15 V. Each time the number of rotations of the photoconductive drum 61 increases by 100,000 rotations, the third correction value Vz increases by 5 V. When the number of rotations of the photoconductive drum 61 is equal to or more than 800,000 rotations, the third correction value Vz is 35 V.

The controller 110 corrects the electrification voltage Vac by adding the third correction value Vz, and notifies the power source unit 100 of the resultant value Vac+Vz as a thickness-correction electrification voltage Vac1. Therefore, the AC power source 102 outputs an AC voltage peak-to-peak voltage of which is the thickness-correction electrification voltage Vac1. That is, the power source unit 100 outputs an AC voltage having an amplitude of Vac1/2 (AC voltage of Vg±Vac1/2) with a DC voltage Vg from the DC power source 101 being a central voltage. The AC voltage is applied to the electrification roller 621.

In the second embodiment, the controller 110 predicts the thickness deviation of the photosensitive layer 615 from the number of rotations of the photoconductive drum 61, and the memory 111 stores the third correction table DT5 shown in FIG. 12. However, based on the calculated discharge starting voltage Vth, the thickness deviation of the photosensitive layer 615 may be predicted. Specifically, as the thickness of the photosensitive layer 615 decreases, the discharge starting voltage Vth decreases. Therefore, it is predicted that when the discharge starting voltage Vth is low, the thickness deviation of the photosensitive layer 615 will be large.

Figure 14:
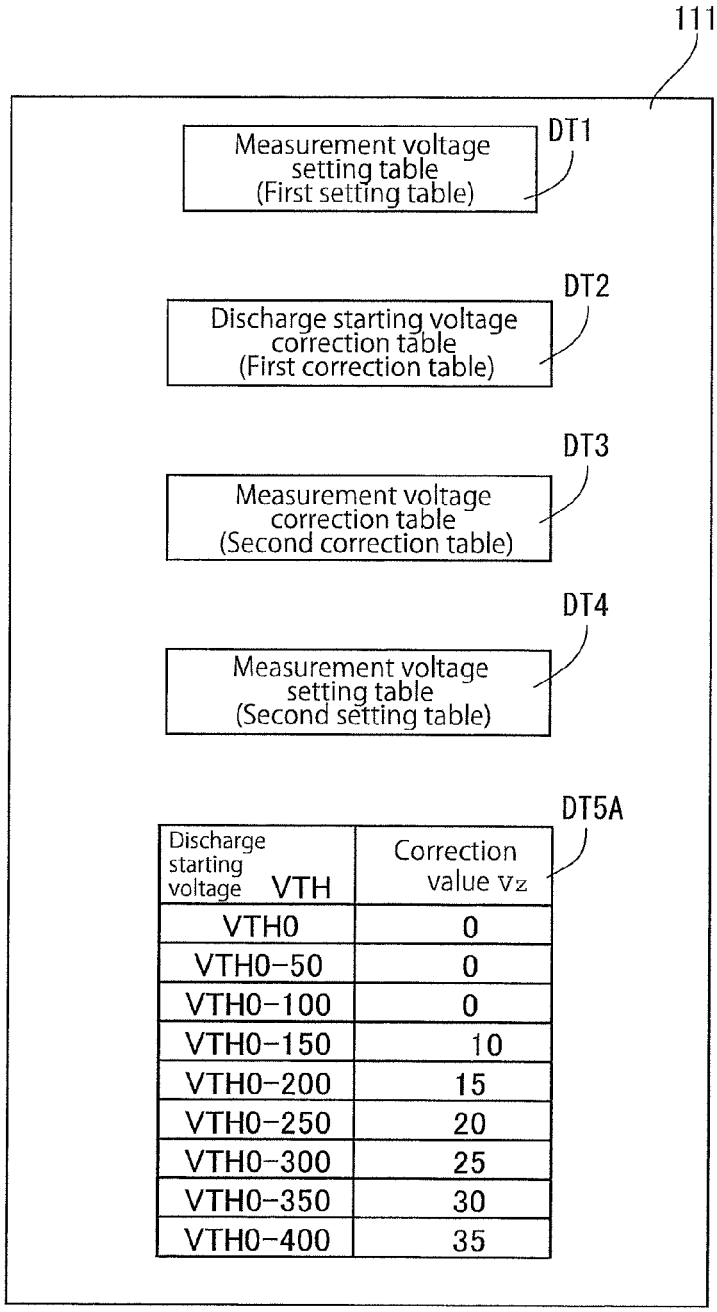
FIG. 14 is a schematic diagram illustrating a different configuration of the memory in the image forming apparatus according to the second embodiment.

At this time, for example, as shown in FIG. 14, the memory 111 stores a third correction table DT5*a* in place of the above-described third correction table DT5. Then, the controller 110 assumes the discharge starting voltage Vth0 in the first measurement as a reference. Also, when acquiring the discharge starting voltage Vth acquired in the second and subsequent measurement, the controller 110 refers to the third correction table DT5*a*. Thus, based on a decrease amount of the discharge starting voltage Vth from the reference voltage Vth0, the controller 110 may acquire the third correction value Vz.

Figure 15:
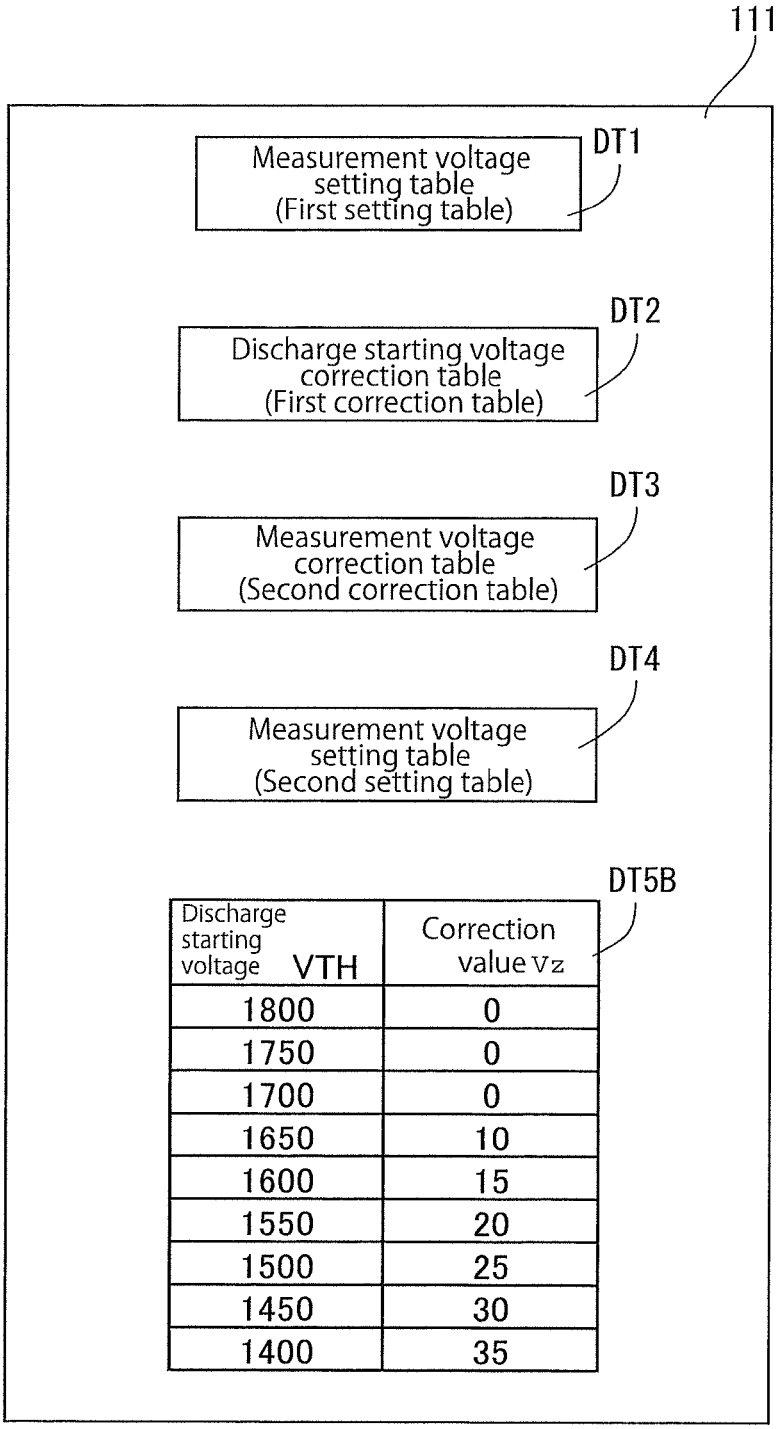
FIG. 15 is a schematic diagram illustrating a different configuration of the memory in the image forming apparatus according to the second embodiment.

In the example shown in FIG. 14, when the decrease amount of the discharge starting voltage Vth from the reference voltage Vth0 is less than 150 V, the third correction value Vz is 0 V. When the decrease amount of the discharge starting voltage Vth from the reference voltage Vth0 is equal to or more than 150 V, the third correction value Vz is 15 V. Further, each time the decrease amount of the discharge starting voltage Vth from the reference voltage Vth0 increases by 50 V, the third correction value Vz increases by 5 V. When the decrease amount of the discharge starting voltage Vth from the reference voltage Vth0 is equal to or more than 400 V, the third correction value Vz is 35 V. As in a third correction table DT5*b* shown in FIG. 15, the reference voltage Vth0 of the discharge starting voltage Vth may be set at a fixed value (1800 V in the example of FIG. 15).

Third Embodiment

Figure 16:
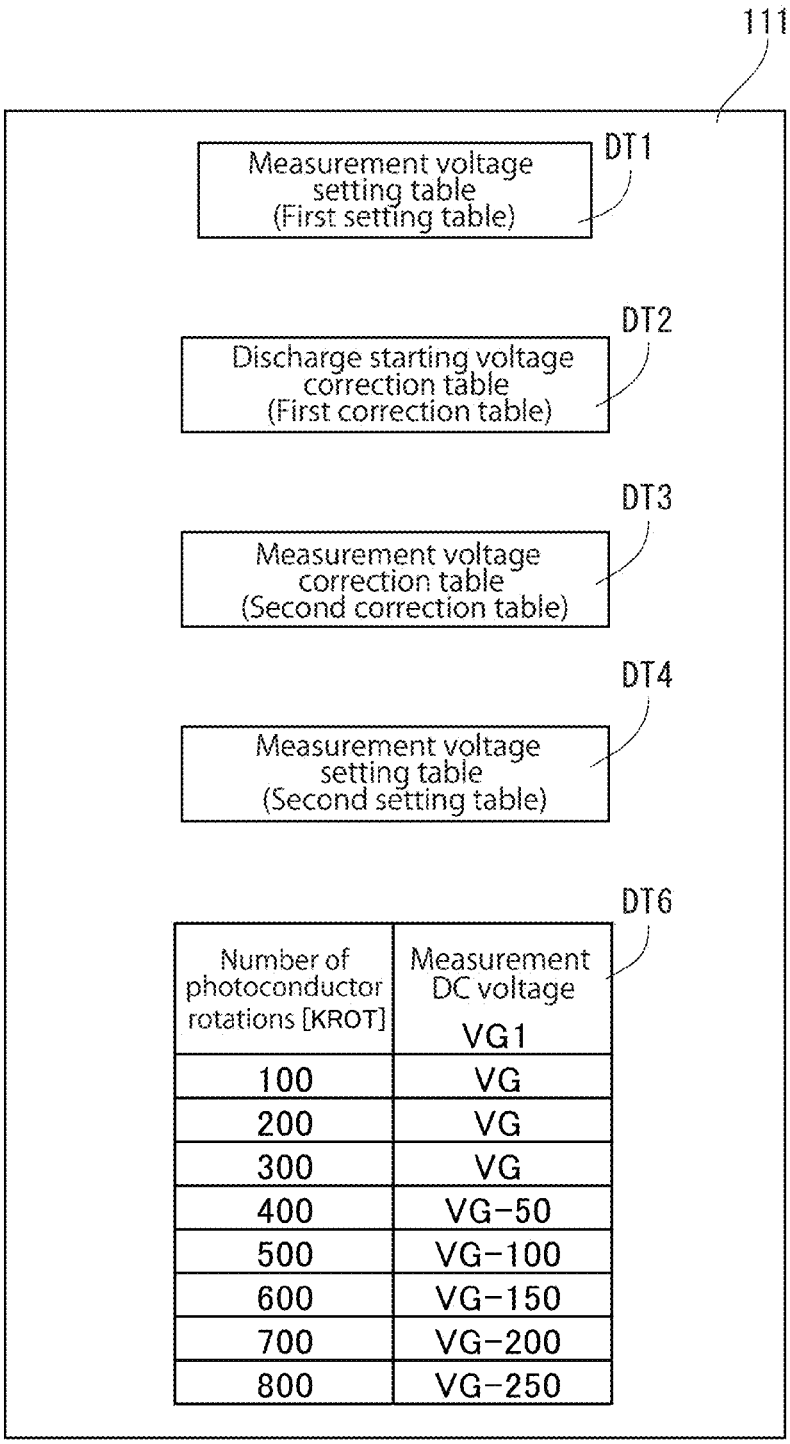
FIG. 16 is a schematic diagram illustrating a configuration of a memory in an image forming apparatus according to a third embodiment.

An image forming apparatus according to a third embodiment of the present invention will be described below with reference to the drawings. FIG. 16 is a diagram illustrating a configuration of tables stored in a memory in the image forming apparatus according to the third embodiment. In the third embodiment, the same components and operations as in the first embodiment will be denoted by the same reference numerals and will not be elaborated here.

In the image forming apparatus 1 according to the third embodiment, as shown in FIG. 16, similarly to the first embodiment (see FIG. 6), the memory 111 stores a measurement voltage setting table (first setting table) DT1, a discharge starting voltage correction table (first correction table) DT2, a measurement voltage correction table (second correction table) DT3, and a measurement voltage setting table (second setting table) DT4. The memory 111 further stores a measurement voltage setting table (third setting table) DT6 for setting a DC voltage Vg1 in the measurement in accordance with the number of rotations of the photoconductive drum 61.

The third embodiment is different from the first and second embodiments in that in measurement operation of a discharge starting voltage Vth, the DC voltage from the DC power source 101 is changed based on the thickness of the photosensitive layer 615 on the photoconductive drum 61. Specifically, in the measurement operation of the discharge starting voltage Vth at each predetermined timing, the controller 110 confirms the number of rotations of the photoconductive drum 61, and refers to the third setting table DT6 to set an absolute value |Vg1| of the DC voltage (DC voltage for measurement, hereinafter referred to as measurement DC voltage) from the DC power source 101. This measurement DC voltage (absolute value) |Vg1| is set with an absolute value |Vg| of the DC voltage (DC voltage for printing, hereinafter referred to as printing DC voltage) as a reference value. The absolute value |Vg| of the printing DC voltage is constant at the time of image formation (printing processing). As the number of rotations of the photoconductive drum 61 increases, the absolute value |Vg1| decreases.

In the third setting table DT6 in the example of FIG. 16, when the number of rotations of the photoconductive drum 61 is less than 400,000 rotations (400 krot), the measurement DC voltage (absolute value) |Vg1| is equal to the printing DC voltage (absolute value) |Vg|. When the number of rotations of the photoconductive drum 61 is equal to or more than 400,000 rotations, the measurement DC voltage (absolute value) |Vg1| is a voltage value (|Vg|−50) V. Each time the number of rotations of the photoconductive drum 61 increases by 100,000 rotations, the measurement DC voltage (absolute value) |Vg1| decreases by 50 V. When the number of rotations of the photoconductive drum 61 is equal to or more than 800,000, the measurement DC voltage (absolute value) |Vg1| is a voltage value (|Vg|−250) V.

In the third embodiment, in the measurement operation of the discharge starting voltage Vth, the controller 110 sets the measurement DC voltage (absolute value) |Vg1| to decrease as the number of rotations of the photoconductive drum 61 increases. In the measurement operation of the discharge starting voltage Vth when the thickness of the photosensitive layer 615 is small, an AC voltage having peak voltage higher than the electrification voltage Vac is applied from the AC power source 102. Even in this case, a potential difference between the photoconductive drum 61 and the electrification roller 621 is decreased. Therefore, even if the thickness of the photosensitive layer 615 is small in the application of the AC voltage having peak voltage higher than the electrification voltage Vac from the AC power source 102 at the time of the measurement, generation of leak current with respect to the photoconductive drum 61 is suppressed to prevent damage to the photoconductive drum 61.

In the third embodiment, the controller 110 predicts the thickness of the photosensitive layer 615 from the number of rotations of the photoconductive drum 61, and the memory 111 stores the third setting table DT6 shown in FIG. 16. However, prediction of the thickness of the photosensitive layer 615 may be executed based on the calculated discharge starting voltage Vth. In this case, as shown in FIG. 17, the memory 111 stores a third setting table DT6*a* in place of the above-described third setting table DT6.

Figure 17:
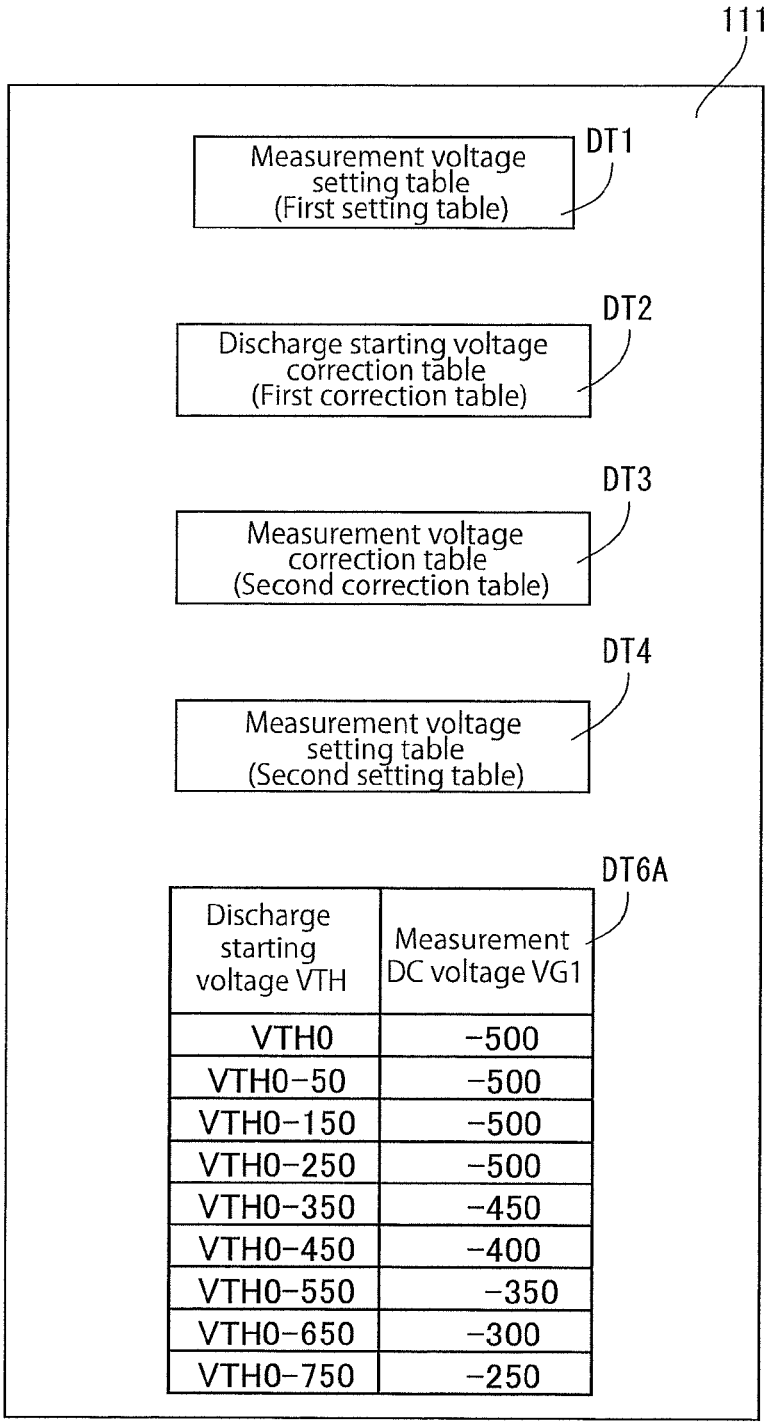
FIG. 17 is a schematic diagram illustrating a different configuration of the memory in the image forming apparatus according to the third embodiment.

In the example of FIG. 17, when a decrease amount of the discharge starting voltage Vth from the reference voltage Vth0 is less than 150 V, the measurement DC voltage Vg1 is −500 V. When the decrease amount of the discharge starting voltage Vth from the reference voltage Vth0 is equal to or more than 150 V, the measurement DC voltage Vg1 is −450 V. Each time the decrease amount of the discharge starting voltage Vth from the reference voltage Vth0 increases by 50 V, the measurement DC voltage Vg1 increases by −50 V. When the decrease amount of the discharge starting voltage Vth from the reference voltage Vth0 is equal to or more than 400 V, the measurement DC voltage Vg1 is −250 V.

In the third embodiment, based on the thickness of the photosensitive layer 615 on the photoconductive drum 61, the measurement DC voltage is changed in stages. However, irrespective of the thickness of the photosensitive layer 615, the absolute value of the measurement DC voltage Vg1 may be set to be lower than the printing DC voltage Vg by a constant value. For example, the measurement DC voltage (absolute value) |Vg1| is set to be lower than the printing DC voltage (absolute value) |Vg| constantly by approximately 200 V.

Moreover, in the third embodiment, the memory 111 may store the electrification voltage correction table (third correction table) DT5 similarly to the second embodiment. At the time of image formation (printing processing), based on the predicted thickness deviation of the photosensitive layer 615, the electrification voltage Vac may be corrected. Thus, the AC voltage applied to the electrification roller 621 by the power source unit 100 has a dischargeable amplitude Vac1/2 at a portion of the photosensitive layer 615 on the photoconductive drum 61 that has the maximum thickness.

The image forming apparatus according to the embodiment of the present invention may be a multifunction peripheral (MFP) having a copy function, a scanner function, a printer function, and a fax function. Also, the image forming apparatus may be a printer or a copying machine or a facsimile.

Obviously, numerous modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. An image forming apparatus comprising:

photoconductors configured to carry electrostatic latent images;

electrifiers disposed in contact with or adjacent to the respective photoconductors and configured to uniformly electrify surfaces of the photoconductors;

a power source configured to apply an electrifying voltage to the electrifiers, the electrifying voltage having an AC voltage superposed on a DC voltage;

a current measurer configured to measure an alternating current caused to flow by application of an AC voltage by the power source;

a controller configured to calculate a discharge starting voltage, which is a peak-to-peak voltage of the AC voltage at which discharge between the photoconductor and the electrifier is started; and environment detectors configured to detect an environment inside of the apparatus, wherein the controller is configured to operate the current measurer at each predetermined timing to acquire the discharge starting voltage, the controller being configured to, when acquiring the discharge starting voltage, change the peak-to-peak voltage of the AC voltage applied by the power source in at least two stages at pre-discharge voltage lower than the discharge starting voltage and at post-discharge voltage higher than the discharge starting voltage, the current measurer being configured to measure alternating current at two or more measurement points of each of the pre-discharge voltage and the post-discharge voltage, the controller being configured to calculate a voltage value at an intersection of a first line and a second line, the first line being acquired from a relationship between a peak-to-peak voltage of an AC voltage and an alternating current at two or more measurement points of the pre-discharge voltage, the second line being acquired from a relationship between a peak-to-peak voltage of an AC voltage and an alternating current at two or more measurement points of the post-discharge voltage, the controller being configured to, after acquiring the discharge starting voltage, calculate an environment-correction discharge starting voltage by correcting the discharge starting voltage based on the environment inside of the apparatus detected by the environment detectors, the controller being configured to set an electrification voltage based on the environment-correction discharge starting voltage, the electrification voltage being a peak-to-peak voltage of the AC voltage applied by the power source in image formation.

2. The image forming apparatus according to claim 1, wherein the controller is configured to set measurement points of each of the pre-discharge voltage and the post-discharge voltage in a measurement other than a first measurement based on an environment-correction discharge starting voltage acquired in a previous measurement.

3. The image forming apparatus according to claim 2, wherein in measuring alternating current for setting the electrification voltage, the measurement points of each of the pre-discharge voltage and the post-discharge voltage in a second and subsequent measurement is fewer than measurement points in a first measurement.

4. The image forming apparatus according to claim 3, wherein the controller is configured to set the measurement points of each of the pre-discharge voltage and the post-discharge voltage based on the environment inside of the apparatus detected by the environment detectors.

5. The image forming apparatus according to claim 2, wherein the controller is configured to set the measurement points of each of the pre-discharge voltage and the post-discharge voltage based on the environment inside of the apparatus detected by the environment detectors.

6. The image forming apparatus according to claim 2, wherein the controller is configured to predict a thickness deviation of a photosensitive layer on the photoconductor, and when the thickness deviation of the photosensitive layer is large, the controller is configured to correct the electrification voltage in image formation into a small value.

7. The image forming apparatus according to claim 1, wherein the controller is configured to set measurement points of each of the pre-discharge voltage and the post-discharge voltage in a measurement other than a first measurement based on a plurality of environment-correction discharge starting voltages acquired in a previous measurement.

8. The image forming apparatus according to claim 7, wherein in measuring alternating current for setting the electrification voltage, the measurement points of each of the pre-discharge voltage and the post-discharge voltage in a second and subsequent measurement is fewer than measurement points in a first measurement.

9. The image forming apparatus according to claim 8, wherein the controller is configured to set the measurement points of each of the pre-discharge voltage and the post-discharge voltage based on the environment inside of the apparatus detected by the environment detectors.

10. The image forming apparatus according to claim 7, wherein the controller is configured to set the measurement points of each of the pre-discharge voltage and the post-discharge voltage based on the environment inside of the apparatus detected by the environment detectors.

11. The image forming apparatus according to claim 1, wherein in measuring alternating current for setting the electrification voltage, the measurement points of each of the pre-discharge voltage and the post-discharge voltage in a second and subsequent measurement is fewer than measurement points in a first measurement.

12. The image forming apparatus according to claim 11, wherein the controller is configured to set the measurement points of each of the pre-discharge voltage and the post-discharge voltage based on the environment inside of the apparatus detected by the environment detectors.

13. The image forming apparatus according to claim 1, wherein the controller is configured to set the measurement points of each of the pre-discharge voltage and the post-discharge voltage based on the environment inside of the apparatus detected by the environment detectors.

14. The image forming apparatus according to claim 1, wherein the controller is configured to predict a thickness deviation of a photosensitive layer on the photoconductor, and when the thickness deviation of the photosensitive layer is large, the controller is configured to correct the electrification voltage in image formation into a small value.

15. The image forming apparatus according to claim 14, wherein the controller is configured to predict the thickness deviation of the photosensitive layer based on a frequency of use of the photoconductor.

16. The image forming apparatus according to claim 14, wherein the controller is configured to predict the thickness deviation of the photosensitive layer based on the calculated discharge starting voltage.

17. The image forming apparatus according to claim 1, wherein the controller is configured to set an absolute value of DC voltage applied by the power source in measurement to be smaller than an absolute value of DC voltage applied by the power source in image formation.

18. The image forming apparatus according to claim 17, wherein the controller is configured to predict a thickness of a photosensitive layer on the photoconductor, and when the thickness of the photosensitive layer is small, the controller is configured to set an absolute value of DC voltage applied by the power source in measurement at a small value.

19. The image forming apparatus according to claim 18, wherein the controller is configured to predict the thickness of the photosensitive layer based on a frequency of use of the photoconductor.

20. The image forming apparatus according to claim 18, wherein the controller is configured to predict the thickness of the photosensitive layer based on the calculated discharge starting voltage.

* * * * *